US008369727B2

(12) United States Patent
Oguchi et al.

(10) Patent No.: US 8,369,727 B2
(45) Date of Patent: Feb. 5, 2013

(54) EXPOSURE HEAD, IMAGE FORMING APPARATUS, AND CONTROL METHOD OF EXPOSURE HEAD

(75) Inventors: Yuki Oguchi, Okaya (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 810 days.

(21) Appl. No.: 12/549,231

(22) Filed: Aug. 27, 2009

(65) Prior Publication Data

US 2010/0052570 A1 Mar. 4, 2010

(30) Foreign Application Priority Data

Aug. 29, 2008 (JP) ..... 2008-222240

(51) Int. Cl.
*G03G 15/043* (2006.01)

(52) U.S. Cl. ..... 399/51; 399/220

(58) Field of Classification Search ..... 399/31, 399/32, 51, 220
See application file for complete search history.

(56) References Cited

U.S. PATENT DOCUMENTS 7,999,837 B2 * 8/2011 Tsujino et al. ..... 347/234
2007/0229647 A1 10/2007 Kawano et al.
2009/0041504 A1 * 2/2009 Yamaguchi et al. ..... 399/220
2009/0060544 A1 * 3/2009 Kawada et al. ..... 399/51
2009/0060580 A1 * 3/2009 Kawada et al. ..... 399/220

FOREIGN PATENT DOCUMENTS

JP 09156155 A 6/1997
JP 2004-082330 3/2004
JP 2007261064 A 10/2007
JP 2008-036937 2/2008

* cited by examiner

*Primary Examiner* — Thuy Vinh Tran
(74) *Attorney, Agent, or Firm* — DLA Piper LLP (US)

(57) ABSTRACT

An exposure head includes: at least one light emitting element; an imaging optical system adapted to image light from the light emitting element; at least one reference element disposed to the light emitting element; and a control section adapted to control light emission of the light emitting element, and to put off the reference element in a latent image forming operation, wherein the control section obtains degree of deterioration of the light emitting element based on an intensity of light emitted by the light emitting element at timing other than timing when the latent image formation operation is executed and an intensity of light emitted by the reference element at the timing other than the timing when the latent image formation operation is executed, and controls light intensity of the light emitting element in the latent image forming operation based on the degree of deterioration.

8 Claims, 17 Drawing Sheets

A-A LINE CROSS-SECTIONAL VIEW

A-A LINE CROSS-SECTIONAL VIEW

EXPOSURE HEAD, IMAGE FORMING APPARATUS, AND CONTROL METHOD OF EXPOSURE HEAD

BACKGROUND

1. Technical Field

The present invention relates to an exposure head adapted to image light from a light emitting element with an imaging optical system, an image forming apparatus using the exposure head, and a control method of the exposure head.

2. Related Art

As such an exposure head, there is described in JP-A-2008-36937 an exposure head having one imaging optical system disposed with respect to a plurality of light emitting elements. The imaging optical system images the light beams from the corresponding plurality of light emitting elements. Then, the imaged light beams expose the exposed surface.

Incidentally, it has been known in the past that the light emitting elements are deteriorated while repeating emission of light, and thus the light intensity is reduced. Further, if such reduction of light intensity occurs, the exposure head might fail to execute a preferable exposure operation. To cope with this point, there is proposed in JP-A-2004-82330 (Document 1) a light intensity control technology for realizing a preferable exposure operation irrespective of the deterioration of the light emitting elements. In this light intensity control technology, the light emitting elements are sequentially driven to emit light in a pre-shipment inspection of the exposure head, and the light intensity of the light thus emitted from the respective light emitting elements is detected by a light intensity sensor. Further, after the shipment, an inspection similar to the pre-shipment inspection is also executed at timing, for example, between an interval of exposure operations or upon powering on. Further, the degree of deterioration of the light emitting elements is obtained based on the light intensity detected in each of the inspections before and after the shipment. Specifically, a proportion (a "correction coefficient" of the Document 1) between the light intensities detected before and after shipment is obtained. By controlling the light intensity of the light emitting elements based on the proportion thus obtained, the light intensity of each of the light emitting elements is equalized irrespective of the deterioration, thereby making the preferable exposure operation possible.

However, the light intensity of the light emitting element also varies with temperature variation. Therefore, if the temperature of the light emitting element is different between the light intensity detection before shipment and the light intensity detection after shipment, the light intensity varies not only by the deterioration but also with temperature variation. As a result, the degree of deterioration might not be obtained accurately in some cases, because the degree of deterioration obtained from the light intensities detected before and after shipment is influenced by the temperature variation. Further, in such a case, there is a possibility that the preferable exposure operation is not executed because the light intensity variation due to the deterioration cannot properly be controlled.

SUMMARY

An advantage of some aspect of the invention is to provide a technology of suppressing the light intensity variation of the light emitting element due to the deterioration thereof, thereby making it possible to execute a preferable exposure operation.

An exposure head according to an aspect of the invention includes at least one light emitting element, an imaging optical system adapted to image light from the light emitting element, at least one reference element disposed to the light emitting element, and a control section adapted to control light emission of the light emitting element, and to put off the reference element in a latent image forming operation, and the control section obtains degree of deterioration of the light emitting element based on an intensity of light emitted by the light emitting element at timing other than timing when the latent image formation operation is executed and an intensity of light emitted by the reference element at the timing other than the timing when the latent image formation operation is executed, and controls light intensity of the light emitting element in the latent image forming operation based on the degree of deterioration.

Further, a control method of an exposure head according to another aspect of the invention includes (a) obtaining, by making light emitting element and a reference element provided to the exposure head emit light, degree of deterioration of the light emitting element based on light intensities of the light emitting element and the reference element, and (b) executing a latent image forming operation of imaging light from the light emitting element by an imaging optical system provided to the exposure head to form a latent image on a latent image carrier while controlling a light intensity of the light emitting element based on the degree of deterioration, and stopping the reference element from emitting light in the latent image forming operation.

Further, an image forming apparatus according to still another aspect of the invention includes a latent image carrier, an exposure head having a light emitting element, an imaging optical system adapted to expose the latent image carrier by imaging light from the light emitting element, and a reference element disposed to the light emitting element, and a control section adapted to control light emission of the light emitting element in a latent image forming operation for providing a latent image to the latent image carrier, and to keep the reference element off in the latent image forming operation, and the control section obtains degree of deterioration of the light emitting element based on an intensity of light emitted by the light emitting element at timing other than timing when the latent image formation operation is executed and an intensity of light emitted by the reference element at the timing other than the timing when the latent image formation operation is executed, and controls light intensity of the light emitting element in the latent image forming operation based on the degree of deterioration.

According to these aspects of the invention (the exposure head, the image forming apparatus, and a control method of an exposure head) configured as described above, the light from a plurality of light emitting elements is imaged by the imaging optical system to perform the latent image forming operation (the exposure operation). The light intensity of the light emitting element thus used in the latent image forming operation is affected by both of the deterioration caused by repeating the latent image forming operation and the temperature. Therefore, as explained in the related art section, in some cases, the degree of deterioration of the light emitting element cannot accurately be obtained. In contrast, in the aspects of the invention, the degree of deterioration of the light emitting element is obtained based on the light intensities of the reference element and a plurality of light emitting elements. The reference element is provided to a plurality of light emitting elements, and at substantially the same temperature as these light emitting elements. Moreover, since the reference elements are kept off during the latent image forming operation, no deterioration is caused by the latent image forming operation. In other words, the aspects of the invention uses the light intensity of the reference elements at substantially the same temperature as that of the light emitting elements and free from the deterioration, thereby making it possible to keep obtaining the degree of deterioration of each of the light emitting elements with high accuracy while suppressing the influence of the temperature. Therefore, by controlling the light intensity of each of the light emitting elements based on the degree of deterioration, the exposure head can suppress the light intensity variation of the light emitting elements due to the deterioration, thereby performing preferable exposure. Further, by using such an exposure head, the image forming apparatus can form a preferable image.

Further, the exposure head can also be configured as follows. The exposure head can be configured that a plurality of light emitting elements is provided, and the reference element is surrounded by the plurality of light emitting elements. Such an configuration is advantageous to making the reference element at substantially the same temperature as that of the light emitting elements, and makes it possible to obtain the degree of deterioration of the light emitting elements with higher accuracy. As a result, the exposure head can perform a preferable exposure operation.

In particular, the exposure head in which the plurality of light emitting elements is disposed symmetrically about a point, and the reference element is disposed at the point of symmetry of the plurality of light emitting elements is advantageous to making the reference element at substantially the same temperature as that of the plurality of light emitting elements. Therefore, the degree of deterioration of the light emitting element can be obtained with higher accuracy, and the exposure head can perform a preferable exposure operation.

It should be noted that it is possible to configure the exposure head so that the reference element is disposed outside the plurality of light emitting elements. Also in such an exposure head, the advantage of the invention to obtain the degree of deterioration of the light emitting element with high accuracy to realize a preferable exposure operation can be obtained.

Further, the invention is particularly preferably applied to the exposure head using the organic Electro-Luminescence elements as the light emitting elements and the reference elements. This is because, since the organic EL elements have the light intensity varying due to deterioration and temperature variation, it is preferable to obtain the degree of deterioration of the light emitting elements by the invention with high accuracy to realize a preferable exposure operation.

Further, the control method of the exposure head can also be configured as follows. Specifically, the control method of the exposure head can be configured so that in step (a), the degree of deterioration of the light emitting element is obtained based on an intensity of light emitted by the light emitting element, an intensity of the light emitted by the reference element, an intensity of light emitted by the light emitting element and stored in a memory section, and an intensity of light emitted by the reference element and stored in the memory section. By configuring the method as described above, even in the case in which the temperature is different between the time point when the light intensity stored in the memory is obtained and the time point when the light emitting elements and the reference element are made to emit light in the step (a), it becomes possible to keep obtaining the degree of deterioration of the light emitting elements while suppressing the influence of the temperature.

BRIEF DESCRIPTION OF THE DRAWINGS

The invention will now be described with reference to the accompanying drawings, wherein like numbers reference like elements.

DESCRIPTION OF EXEMPLARY EMBODIMENTS

Figure 1:
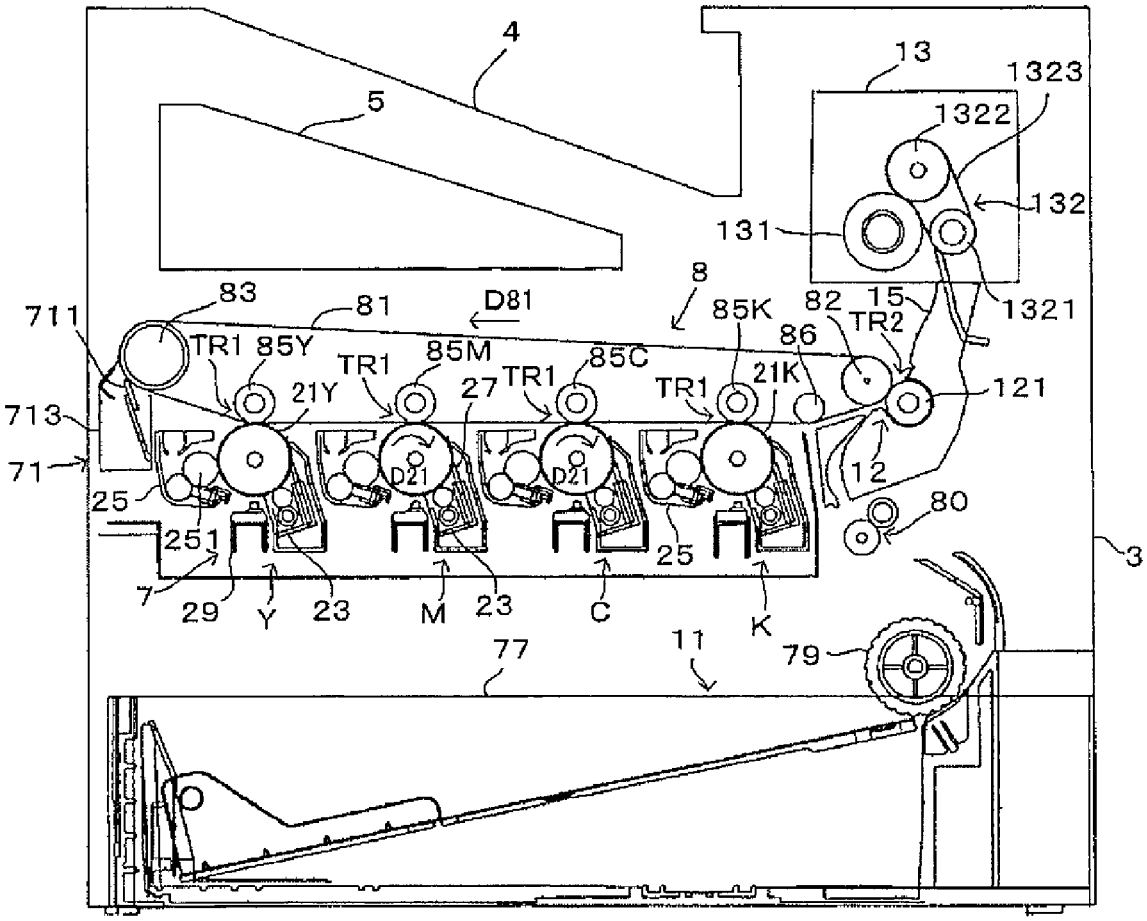
FIG. 1 is a diagram showing an example of an image forming apparatus equipped with a line head to which the invention can be applied.
Figure 2:
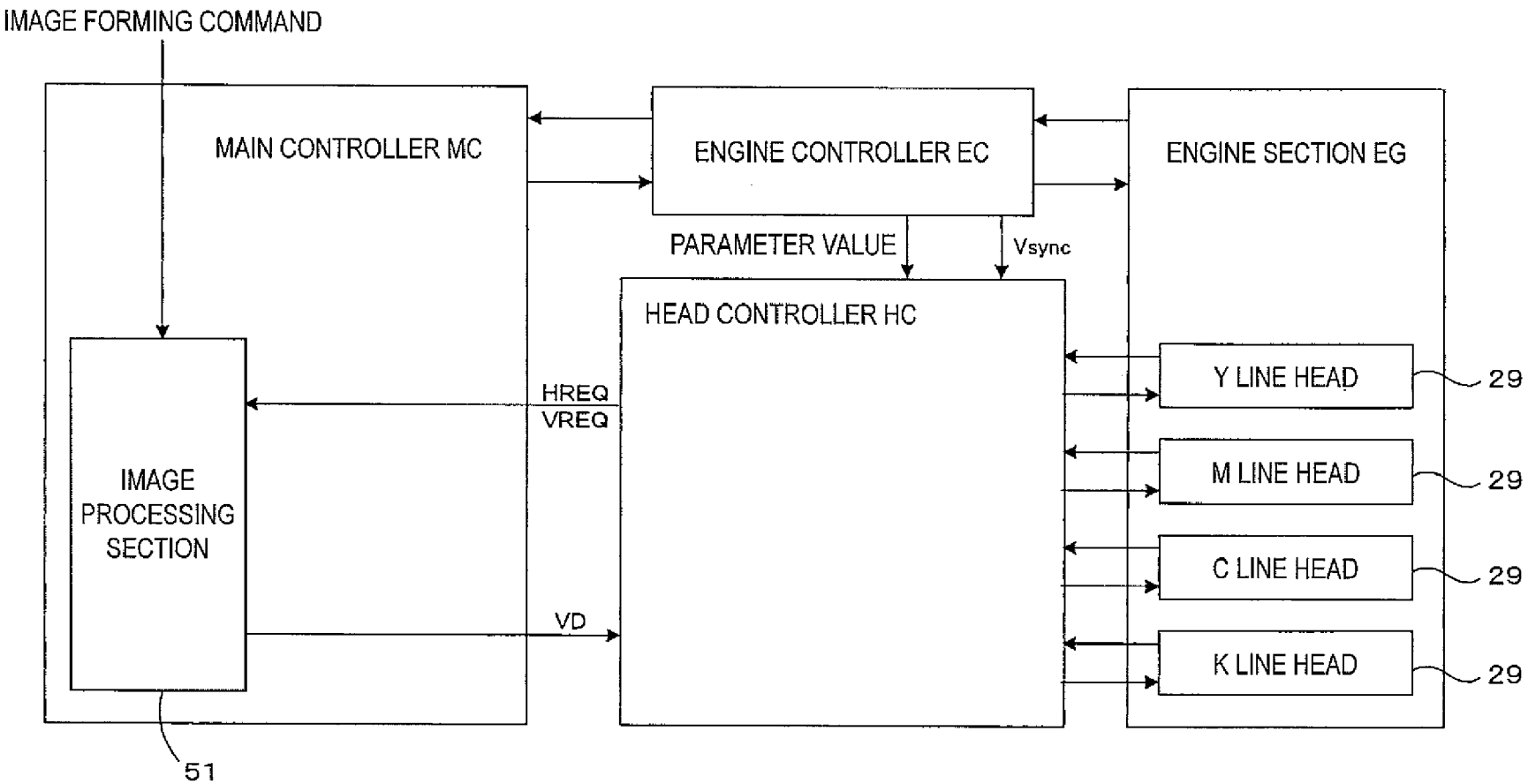
FIG. 2 is a diagram showing an electrical configuration of the image forming apparatus shown in FIG. 1.

FIG. 1 is a diagram showing an example of an image forming apparatus equipped with a line head to which the invention can be applied. Further, FIG. 2 is a diagram showing an electrical configuration of the image forming apparatus shown in FIG. 1. The apparatus is an image forming apparatus capable of operating selectively in a color mode in which a color image is formed by overlapping four colors of toners of black (K), cyan (C), magenta (M), and yellow (Y), and a monochrome mode in which a monochrome image is formed using only the black (K) toner. It should be noted that FIG. 1 is a drawing corresponding to a state when operating in the color mode. In the present image forming apparatus, when an image formation command is provided to a main controller MC having a CPU, a memory, and so on from an external device such as a host computer, the main controller MC provides an engine controller EC with a control signal and so on, and at the same time provides a head controller HC with the video data VD corresponding to the image formation command. Further, the head controller HC controls line heads 29 in charge of respective colors based on the video data VD from the main controller MC, and a vertical sync signal Vsync and parameter values from the engine controller EC. Thus, an engine section EG performs a prescribed image forming operation, thereby forming an image corresponding to the image formation command on a sheet such as copy paper, transfer paper, a form, or an OHP transparent sheet.

Inside a main housing 3 provided to the image forming apparatus, there is disposed an electric component box 5 housing a power supply circuit board, the main controller MC, the engine controller EC, and the head controller HC. Further, an image forming unit 7, a transfer belt unit 8, and a paper feed unit 11 are also disposed inside the main housing 3. Further, inside the main housing 3 and on the right side thereof in FIG. 1, there are disposed a secondary transfer unit 12, a fixing unit 13, and a sheet guide member 15. It should be noted that the paper feed unit 11 is configured so as to be detachably attached to a main body of the apparatus. Further, there is adopted a configuration in which the paper feed unit 11 and the transfer belt unit 8 can separately be detached to be repaired or replaced.

The image forming unit 7 is provided with four image forming stations Y (for yellow), M (for magenta), C (for cyan), and K (for black) for forming images with respective colors different from each other. Further, each of the image forming stations Y, M, C, and K is provided with a cylindrical photoconductor drum 21 having a surface with a predetermined length in the main-scanning direction MD. Further, each of the image forming stations Y, M, C, and K forms a toner image of the corresponding color on the surface of the photoconductor drum 21. The photoconductor drum is disposed so as to have the axial direction thereof parallel or substantially parallel to the main-scanning direction MD. Further, each of the photoconductor drums 21 is connected to a dedicated drive motor, and is driven to rotate at a predetermined velocity in a direction of the arrow D21 in the drawing. Thus, the surface of the photoconductor drum 21 is moved in the sub-scanning direction SD perpendicular to or substantially perpendicular to the main-scanning direction MD. Further, around the photoconductor drum 21, there are disposed along the rotational direction, a charging section 23, the line head 29, a developing section 25, and a photoconductor cleaner 27. Further, a charging operation, a latent image forming operation, and a toner developing operation are executed by these functional sections. Therefore, when operating in the color mode, the toner images respectively formed by all of the image forming stations Y, M, C, and K are overlapped on a transfer belt 81 provided to the transfer belt unit 8 to form a color image, and when operating in the monochrome mode, a monochrome image is formed using only the toner image formed by the image forming station K. It should be noted that in FIG. 1, since the image forming stations in the image forming unit 7 have the same configurations as each other, the reference numerals are only provided to some of the image forming stations, and are omitted in the rest of the image forming stations only for the sake of convenience of illustration.

The charging section 23 is provided with a charging roller having a surface made of elastic rubber. The charging roller is configured so as to be rotated by the contact with the surface of the photoconductor drum 21 at a charging position, and is rotated in association with the rotational operation of the photoconductor drum 21 in a driven direction with respect to the photoconductor drum 21 at a circumferential velocity. Further, the charging roller is connected to a charging bias generating section (not shown), accepts the power supply for the charging bias from the charging bias generating section, and charges the surface of the photoconductor drum 21 at the charging position where the charging section 23 and the photoconductor drum 21 have contact with each other.

The line head 29 is provided with a plurality of light emitting elements, and is disposed apart from the photoconductor drum 21. Further, these light emitting elements emit light onto the surface of the photoconductor drum 21 charged by the charging section 23, thereby forming an electrostatic latent image on the surface thereof.

The developing section 25 has a developing roller 251 with a surface holding the toner. Further, the charged toner is moved to the photoconductor drum 21 from the developing roller 251 by a developing bias applied to the developing roller 251 from a developing bias generating section (not shown) electrically connected to the developing roller 251 at the developing position where the developing roller 251 and the photoconductor drum 21 have contact with each other, thereby making the electrostatic latent image formed by the line head 29 visible.

The toner image thus made visible at the developing position is fed in the rotational direction D21 of the photoconductor drum 21, and then primary-transferred to the transfer belt 81 described later in detail at a primary transfer position TR1 where the transfer belt 81 and each of the photoconductor drums 21 have contact with each other.

Further, in the present embodiment, the photoconductor cleaner 27 is disposed downstream of the primary transfer position TR1 and upstream of the charging section 23 in the rotational direction D21 of the photoconductor drum 21 so as to have contact with the surface of the photoconductor drum 21. The photoconductor cleaner 27 removes the residual toner on the surface of the photoconductor drum 21 after the primary transfer to clean the surface thereof by having contact with the surface of the photoconductor drum 21.

The transfer belt unit 8 is provided with a drive roller 82, a driven roller 83 (hereinafter also referred to as a blade-opposed roller 83) disposed on the left of the drive roller 82 in FIG. 1, and the transfer belt 81 stretched across these rollers and circularly driven in the direction (a feeding direction) of the arrow D81 shown in the drawing. Further, the transfer belt unit 8 is provided with four primary transfer rollers 85Y, 85M, 85C, and 85K disposed inside the transfer belt 81 respectively and opposed one-on-one to the photoconductor drums 21 included in the image forming stations Y, M, C, and K when the photoconductor cartridges are mounted. These primary transfer rollers 85 are electrically connected separately to a primary transfer bias generating section (not shown). Further, when operating in the color mode, all of the primary transfer rollers 85Y, 85M, 85C, and 85K are positioned on the side of the image forming stations Y, M, C, and K as shown in FIG. 1 to press the transfer belt 81 against the photoconductor drums 21 included in the respective image forming stations Y, M, C, and K, thereby forming the primary transfer position TR1 between each of the photoconductor drums 21 and the transfer belt 81. Then, by applying the primary transfer bias to the primary transfer rollers 85 from the primary transfer bias generating section at appropriate timing, the toner images formed on the surfaces of the photoconductor drums 21 are transferred to the surface of the transfer belt 81 at the respective primary transfer positions TR1 to form a color image.

On the other hand, when operating in the monochrome mode, the primary transfer rollers 85Y, 85M, and 85C for color printing among the four primary transfer rollers 85 are separated from the image forming stations Y, M and C respectively opposed thereto, while only the primary transfer roller 85K mainly for monochrome printing is pressed against the image forming station K, thus making only the image forming station K mainly for monochrome printing have contact with the transfer belt 81. As a result, the primary transfer position TR1 is formed only between the primary transfer roller 85K mainly for monochrome printing and the corresponding image forming station K. Then, by applying the primary transfer bias to the primary transfer roller 85K mainly for monochrome printing from the primary transfer bias generating section at appropriate timing, the toner image formed on the surface of the photoconductor drum 21 is transferred to the surface of the transfer belt 81 at the primary transfer position TR1 to form a monochrome image.

Further, the transfer belt unit 8 is provided with a downstream guide roller 86 disposed on the downstream side of the primary transfer roller 85K mainly for monochrome printing and on the upstream side of the drive roller 82. Further, the downstream guide roller 86 is arranged to have contact with the transfer belt 81 on a common internal tangent of the primary transfer roller 85K and the photoconductor drum 21 at the primary transfer position TR1 formed by the primary transfer roller 85K mainly for monochrome printing having contact with the photoconductor drum 21 of the image forming station K.

The drive roller 82 circularly drives the transfer belt 81 in the direction of the arrow D81 shown in the drawing, and at the same time functions as a backup roller of a secondary transfer roller 121. On the peripheral surface of the drive roller 82, there is formed a rubber layer with a thickness of about 3 mm and a volume resistivity of no greater than 1000 kΩ·cm, which, when grounded via a metal shaft, serves as a conducting path for a secondary transfer bias supplied from a secondary transfer bias generating section, not shown, via the secondary transfer roller 121. By thus providing the rubber layer having an abrasion resistance and a shock absorbing property to the drive roller 82, the impact caused by a sheet entering the contact section (a secondary transfer position TR2) between the drive roller 82 and the secondary transfer roller 121 is hardly transmitted to the transfer belt 81, thus the degradation of the image quality can be prevented.

The paper feed unit 11 is provided with a paper feed section including a paper feed cassette 77 capable of holding a stack of sheets, and a pickup roller 79 for feeding the sheet one-by-one from the paper feed cassette 77. The sheet fed by the pickup roller 79 from the paper feed section is fed to the secondary transfer position TR2 along the sheet guide member 15 after the feed timing thereof is adjusted by a pair of resist rollers 80.

The secondary transfer roller 121 is provided so as to be able to be selectively contacted with and separated from the transfer belt 81, and is driven to be selectively contacted with and separated from the transfer belt 81 by a secondary transfer roller drive mechanism (not shown). The fixing unit 13 has a heating roller 131, which is rotatable and incorporates a heater such as a halogen heater, and a pressing section 132 for biasing the heating roller 131 to be pressed against an object. Then, the sheet with the image, which is secondary-transferred on the surface thereof, is guided by the sheet guide member 15 to a nipping section formed with the heating roller 131 and a pressing belt 1323 of the pressing section 132, and the image is thermally fixed in the nipping section at predetermined temperature. The pressing section 132 is composed of two rollers 1321, 1322 and the pressing belt 1323 stretched across the two rollers. Further, it is arranged that by pressing a tensioned part of the surface of the pressing belt 1323, which is stretched by the two rollers 1321, 1322, against the peripheral surface of the heating roller 131, a large nipping section can be formed between the heating roller 131 and the pressing belt 1323. Further, the sheet on which the fixing process is thus executed is fed to a paper catch tray 4 disposed on an upper surface section of the main housing 3.

Further, in the present apparatus, a cleaner section 71 is disposed so as to face the blade-opposed roller 83. The cleaner section 71 has a cleaner blade 711 and a waste toner box 713. The cleaner blade 711 removes foreign matters such as the toner remaining on the transfer belt 81 after executing the secondary transfer process or paper dust by pressing a tip section thereof against the blade-opposed roller 83 via the transfer belt 81. Then, the foreign matters thus removed are collected into the waste toner box 713.

Figure 3:
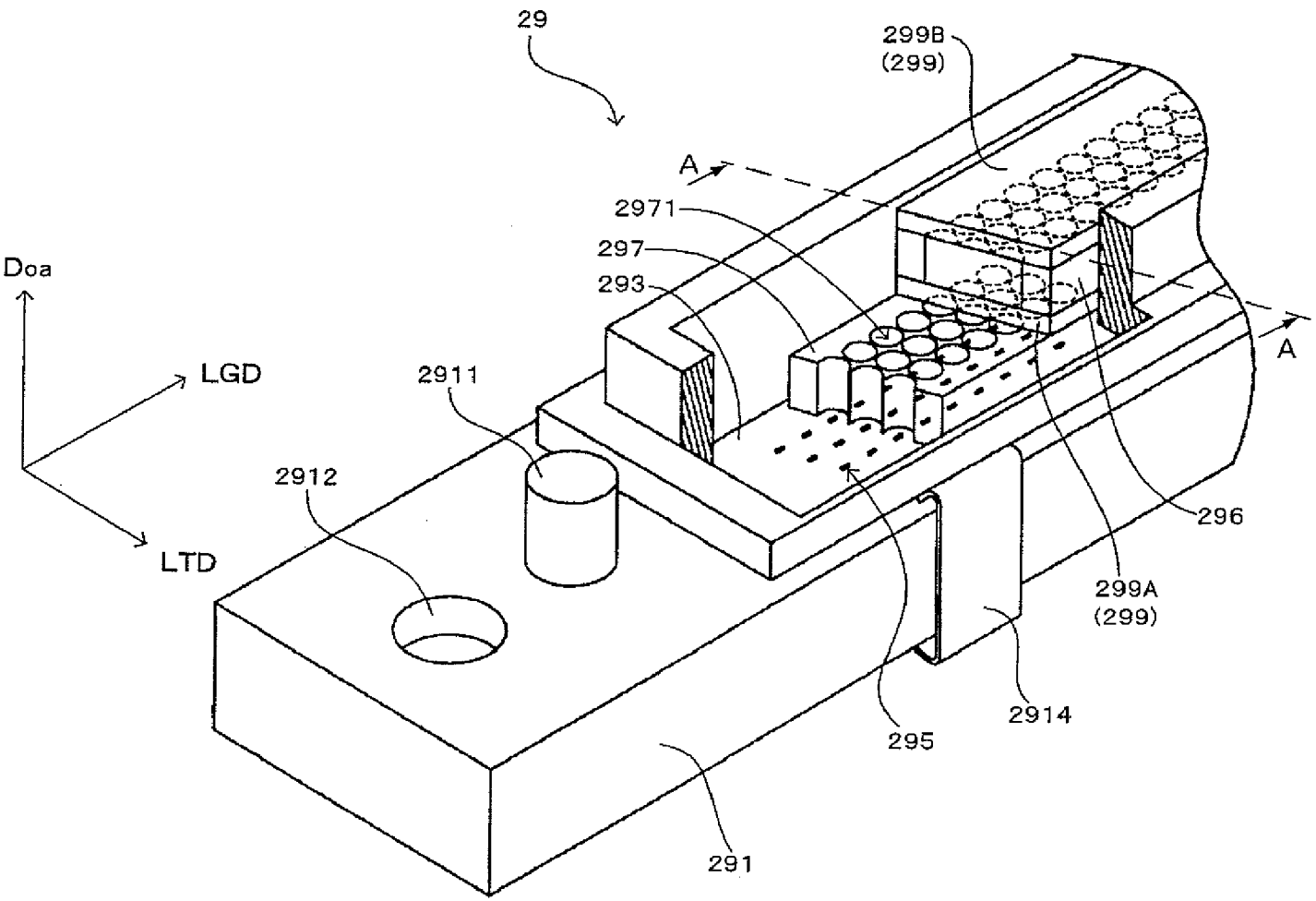
FIG. 3 is a perspective view schematically showing a line head to which the invention can be applied.
Figure 4:
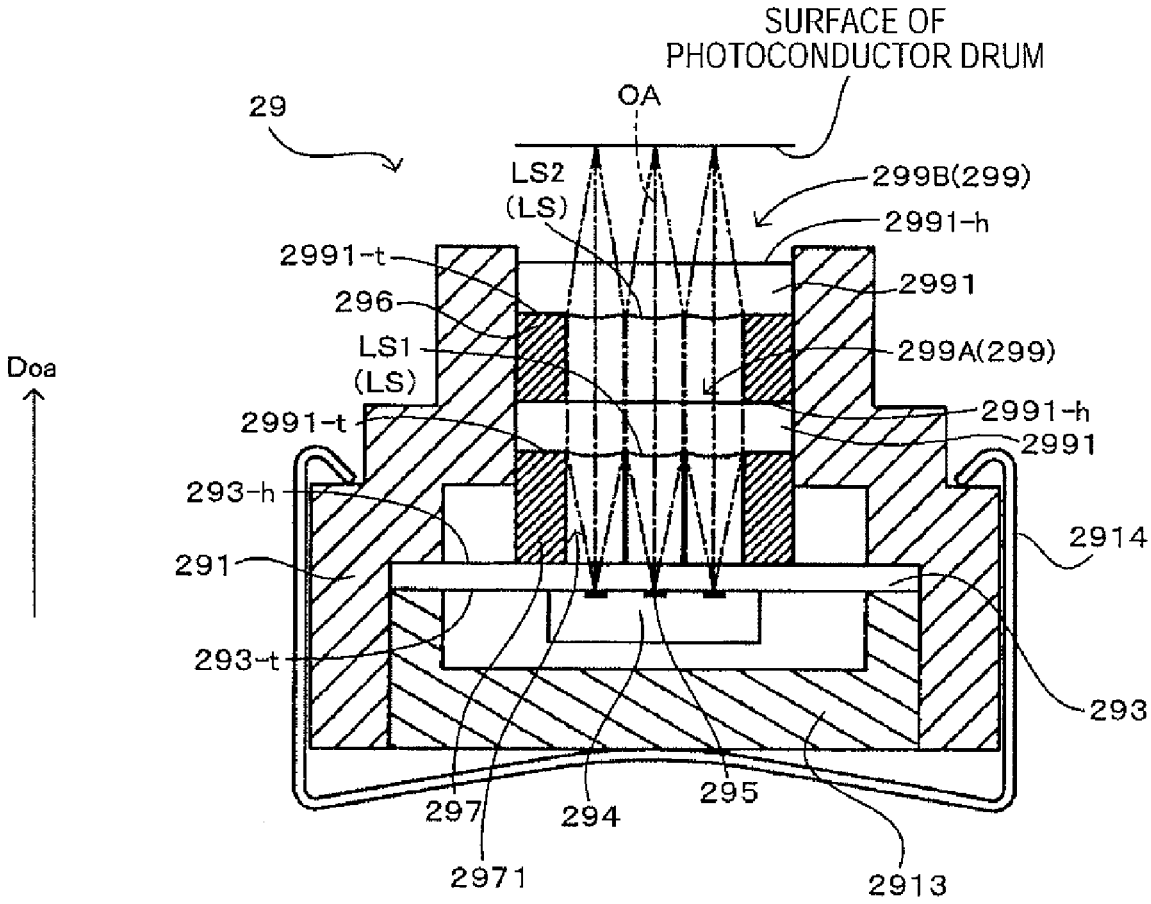
FIG. 4 is a partial cross-sectional view of the line head shown in FIG. 3 along the A-A line.

FIG. 3 is a perspective view schematically showing the line head to which the invention can be applied. Further, FIG. 4 is a partial cross-sectional view of the line head shown in FIG. 3 along the A-A line, and shows a cross-sectional surface parallel to the optical axis OA of a lens. It should be noted that the A-A line is parallel or substantially parallel to a light emitting element group column 295C and a lens column LSC described later. A longitudinal direction LGD of the line head 29 is parallel or substantially parallel to a main-scanning direction MD, and a width direction LTD of the line head 29 is parallel or substantially parallel to a sub-scanning direction SD. It should also be noted that the longitudinal direction LGD and the width direction LTD thereof are perpendicular or substantially perpendicular to each other. As described later, in the line head 29, a head substrate 293 is provided with a plurality of light emitting elements, and each of the light emitting elements emits a light beam towards the surface of the photoconductor drum 21. Therefore, in the present specification, a direction perpendicular to the longitudinal direction LGD and the width direction LTD and proceeding from the light emitting element toward the surface of the photoconductor drum is defined as a proceeding direction Doa of the light beam. The proceeding direction Doa of the light beam is parallel or substantially parallel to the optical axis OA of the lens.

The line head 29 is provided with a case 291, and each end of the case 291 in the longitudinal direction LGD is provided with a positioning pin 2911 and a screw hole 2912. Further, by fitting the positioning pin into a positioning hole (not shown) provided to a photoconductor cover (not shown) covering the photoconductor drum 21 and positioned with respect to the photoconductor drum 21, the line head 29 is positioned with respect to the photoconductor drum 21. Further, setscrews are screwed in and fixed to the screw holes (not shown) of the photoconductor cover via the screw holes 2912, thereby positioning and fixing the line head 29 to the photoconductor drum 21.

Inside the case 291, there are disposed a head substrate 293, a light shielding member 297, and two lens arrays 299 (299A, 299B). An inner surface of the case 291 has contact with a front surface 293-*h* of the head substrate 293, while the reverse surface 293-*t* of the head substrate 293 has contact with a back lid 2913. The back lid 2913 is pressed by a retainer 2914 against an inner surface of the case 291 via the head substrate 293. Specifically, the retainer 2914 has elastic force for pressing the back lid 2913 towards the inner surface (the upper side in FIG. 4) of the case 291, and seals the inside of the case 291 light-tightly (in other words, so that light does not leak from the inside of the case 291 and that light does not enter from the outside of the case 291) by pressing the back lid with such elastic force. It should be noted that the retainer 2914 is disposed in each of a plurality of positions in the longitudinal direction LGD of the case 291.

The reverse surface 293-*t* of the head substrate 293 is provided with light emitting element groups 295 each formed by grouping a plurality of light emitting elements. The head substrate 293 is formed of a light transmissive material such as glass, and the light beam emitted from each light emitting element of the light emitting element group 295 can be transmitted from the reverse surface 293-*t* of the head substrate 293 to the front surface 293-*h* thereof. The light emitting elements are bottom emission organic EL (electroluminescence) elements, and covered by a sealing member 294. When being driven with an electrical current, the light emitting elements 2951 emit light beams with wavelengths identical to each other. The light emitting element 2951 is a so-called perfect diffuse surface light source, and the light beam emitted from the light emitting surface thereof follows Lambert's cosine law.

Figure 5:
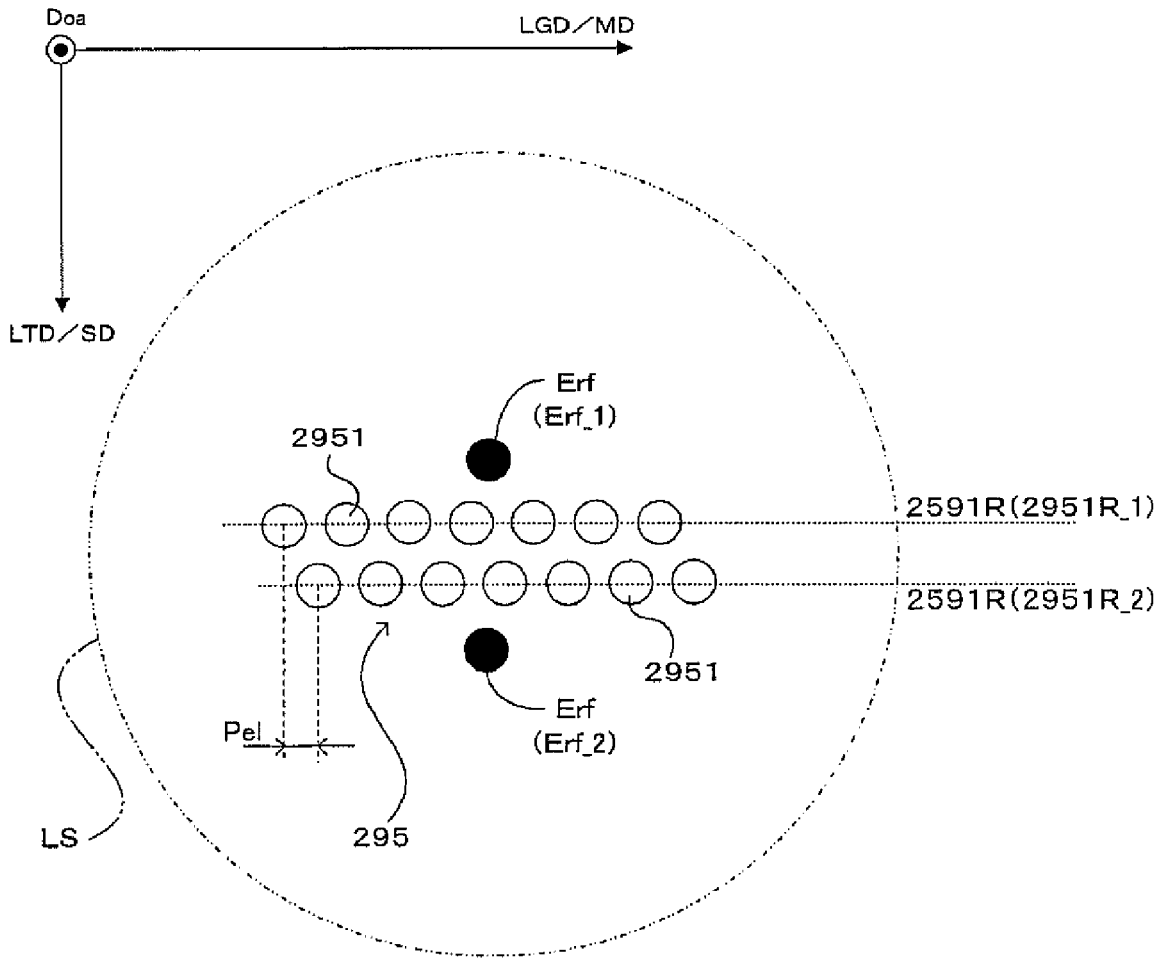
FIG. 5 is a plan view showing a configuration of a light emitting element group disposed on a reverse surface of a head substrate.
Figure 6:
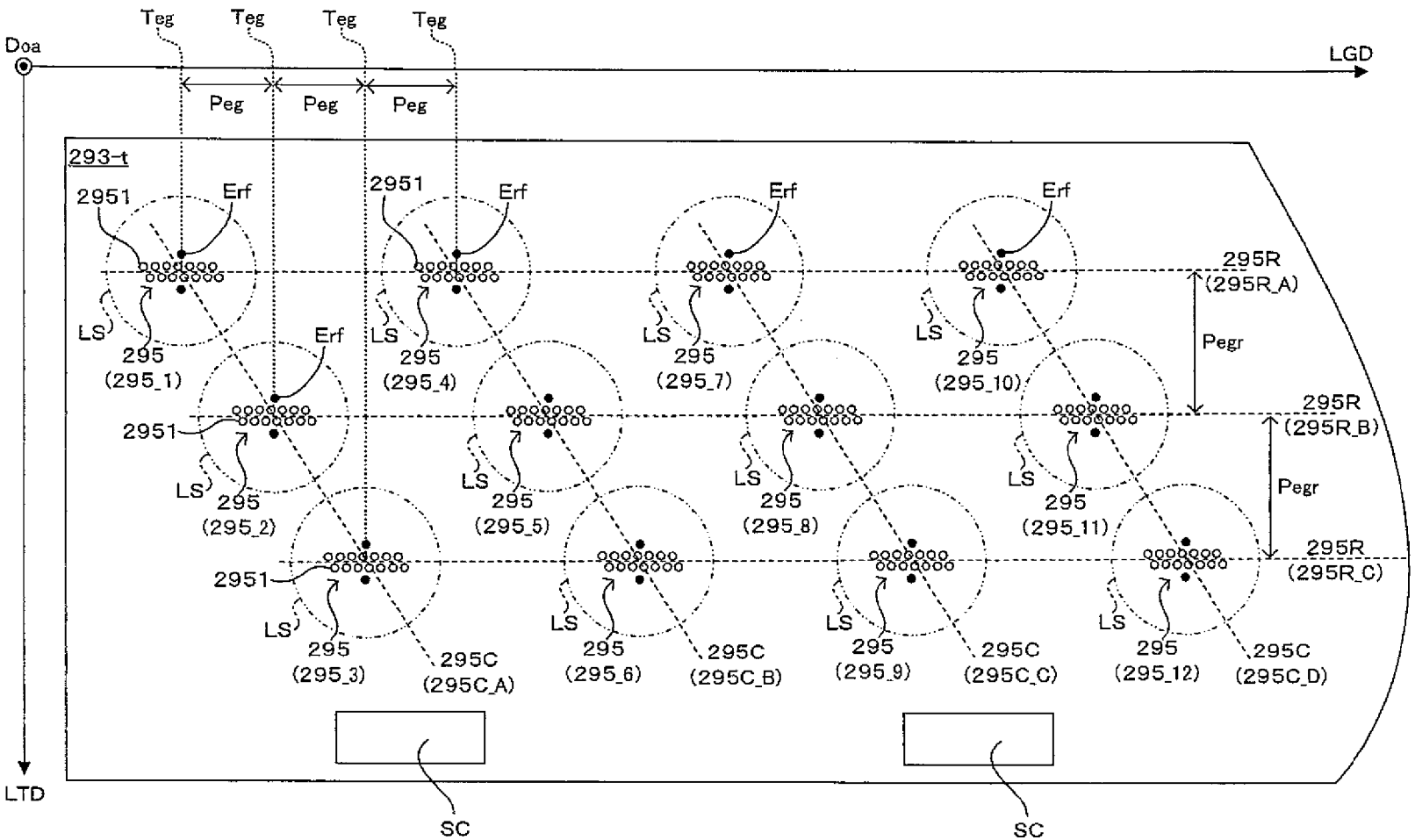
FIG. 6 is a plan view showing a configuration of the reverse side of the head substrate.

FIG. 5 is a plan view showing a configuration of the light element group provided to the reverse surface of the head substrate, and FIG. 6 is a plan view showing a configuration of the reverse surface of the head substrate, both of which correspond to the case of viewing the reverse surface from the front surface side of the head substrate. It should be noted that although in these drawings the lenses LS are illustrated with the double-dashed lines, this is for showing the positional relationship between the light emitting element group 295 and the lenses LS, but not for indicating that the lenses LS are formed on the reverse surface 293-*t* of the head substrate. As shown in FIG. 5, in the present embodiment, there are disposed exposing light emitting elements 2951 (white circles) for exposing the surface of the photoconductor drum 21, and reference elements Erf (black circles), which are not used in an exposure operation. Further, one light emitting element group 295 is formed by grouping fourteen light emitting elements 2951. Specifically, seven light emitting elements 2951 are disposed in the longitudinal direction LGD with a pitch two times as large as a light emitting element pitch Pel to form a light emitting element row 2951R, and two light emitting element rows 2951R_1, 2951R_2 are disposed at different positions in the width direction LTD. Further, these two light emitting element rows 2951R_1, 2951R_2 are shifted light emitting element pitch Pel from each other. As a result, in the light emitting element group 295, the light emitting elements 2951 are disposed at positions different from each other in the longitudinal direction LGD. Further, with respect to each of the light emitting element groups 295, there are disposed two reference elements Erf_1, Erf_2 outside the light emitting element group 295. Specifically, the reference element Erf_1 is disposed with respect to the light emitting element row 2951R_1 of the light emitting element group 295, and located on one side (the upper side in FIGS. 5 and 6) in the width direction LTD of the light emitting element group 295. Further, the reference element Erf_2 is disposed with respect to the light emitting element row 2951R_2 of the light emitting element group 295, and located on the other side (the lower side in FIGS. 5 and 6) in the width direction LTD of the light emitting element group 295. Further, the reference elements Erf are also bottom emission organic Electro-Luminescence elements similarly to the light emitting elements 2951. Further, as shown in FIG. 6, a plurality of light emitting element groups 295 is arranged two-dimensionally apart from each other. Details thereof are as follows.

Three light emitting element groups 295 are disposed at positions different from each other in the width direction LTD, thereby forming the light emitting element group column 295C. In each of the light emitting element group columns 295C, there are disposed three light emitting element groups 295 shifted a light emitting element group pitch Peg from each other in the longitudinal direction LGD. Further, a plurality of light emitting element group columns 295C is disposed in the longitudinal direction LGD with a light emitting element group column pitch (=Peg×3). In the manner described above, the light emitting element groups 295 are disposed in the longitudinal direction LGD with the light emitting element group pitch Peg, and the positions Teg of the light emitting element groups 295 in the longitudinal direction LGD are different from each other.

From another perspective, it can also be said that the light emitting element groups 295 are disposed as follows. That is, in the reverse surface 293-*t* of the head substrate 293, a plurality of light emitting element groups 295 is disposed in the longitudinal direction LGD to form the light emitting element group row 295R, and at the same time, three light emitting element group rows 295R are disposed at positions different from each other in the width direction LTD. These three light emitting element group rows 295R are disposed in the width direction LTD with a light emitting element group row pitch Pegr. Moreover, the light emitting element group rows 295R are shifted the light emitting element group pitch Peg from each other in the longitudinal direction LGD. Therefore, a plurality of light emitting element groups 295 are disposed in the longitudinal direction LGD with the light emitting element group pitch Peg, and the positions Teg of the light emitting element groups 295 in the longitudinal direction LGD are different from each other.

Here, the position of the light emitting element group 295 can be obtained as the centroid of the light emitting element group 295 viewed from the proceeding direction Doa of the light. The centroid of the light emitting element group 295 can be obtained as the centroid of the plurality of light emitting elements 2951 forming the light emitting element group 295 when viewing the plurality of light emitting elements 2951 from the proceeding direction Doa of the light. Further, the light emitting element group pitch Peg can be obtained as a distance between the positions Teg of the two light emitting element groups 295 (e.g., the light emitting element groups 295_1, 295_2) in the longitudinal direction LGD having the positions Teg in the longitudinal direction LGD adjacent to each other. It should be noted that in FIG. 6, the position Teg of the light emitting element group 295 in the longitudinal direction LGD is represented as a foot of the perpendicular drawn from the position of the light emitting element group 295 to the axis of the longitudinal direction LGD.

Figure 9:
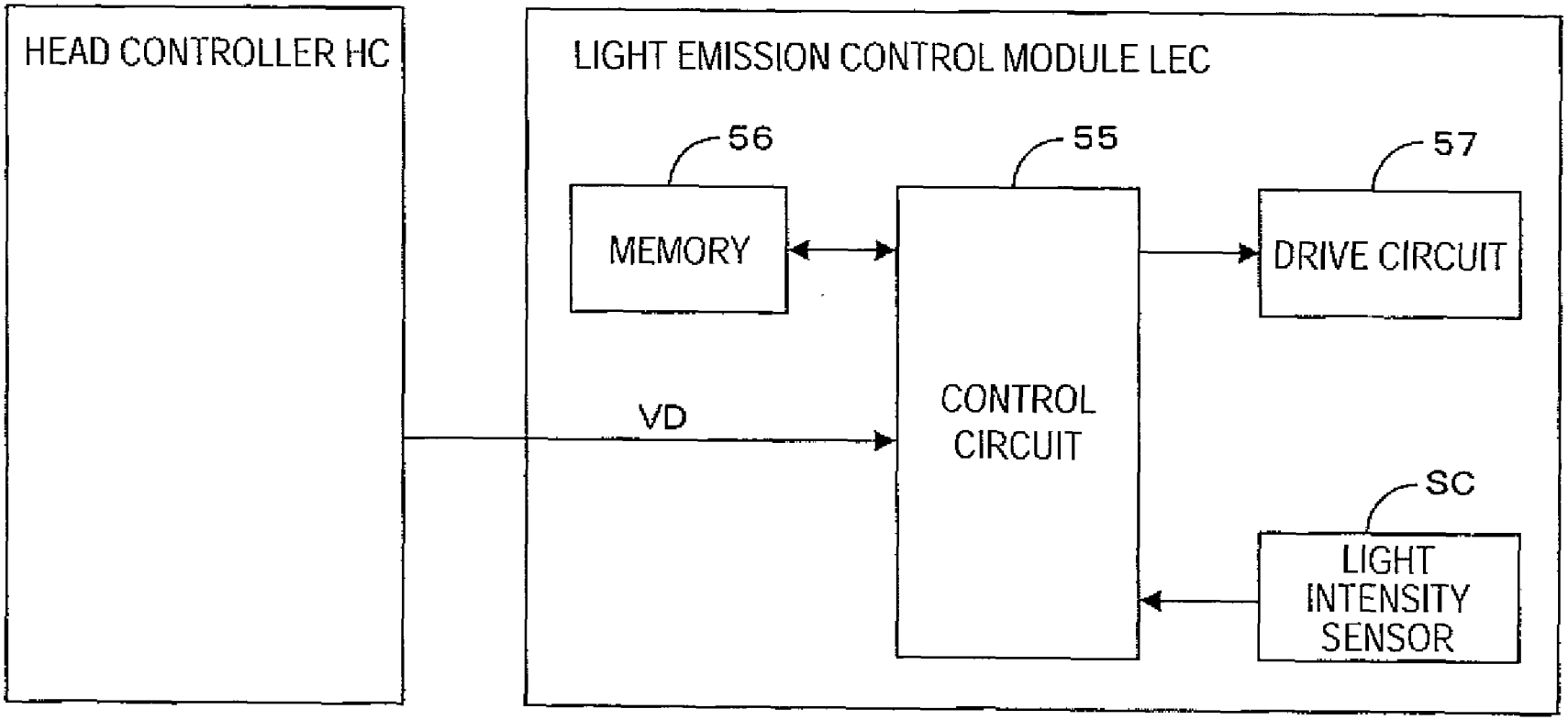
FIG. 9 is a block diagram showing a configuration of a light emission control module.

The reverse surface 293-*t* of the head substrate 293 is provided with a plurality of light intensity sensors SC disposed in the longitudinal direction LGD. Each of the light intensity sensors SC detects the light emitted by the light emitting element 2951 or the light emitted by the reference element described later. Further, the light intensity sensors SC output the detection values to the light emission control module LEC described later (FIG. 9).

Going back to FIGS. 3 and 4, the explanation will be continued. The front surface 293-*h* of the head substrate 293 is provided with a light shielding member 297 so as to have contact therewith. The light shielding member 297 is provided with light guide holes 2971 so as to correspond to the plurality of light emitting element groups 295 (in other words, the light guide holes 2971 are provided so as to correspond one-on-one to the light emitting element groups 295). Each of the light guide holes 2971 is provided to the light shielding member 297 as a hole penetrating through the light shielding member 297 in the proceeding direction Doa of the light beam. Further, on the upper side (the opposite side to the head substrate 293) of the light shielding member 297, there are disposed two lens arrays 299 side by side in the proceeding direction Doa of the light beam.

As described above, in the proceeding direction of the light beam, the light shielding member 297 provided with the light guide holes 2971 corresponding respectively to the light emitting element groups 295 is disposed between the light emitting element groups 295 and the lens arrays 299. Therefore, the light beam output from the light emitting element group 295 passes through the light guide hole 2971 corresponding to the light emitting element group 295, and proceeds toward the lens arrays 299. Conversely, the light beams proceeding towards other areas than the light guide hole 2971 corresponding to the light emitting element group 295 out of the light beams emitted from the light emitting element group 295 are blocked by the light shielding member 297. Thus, all of the light beams emitted from the same light emitting element group 295 proceed towards the lens arrays 299 via the same light guide hole 2971, and the interference between the light beams emitted from different light emitting element groups 295 can be prevented by the light shielding member 297.

Figure 7:
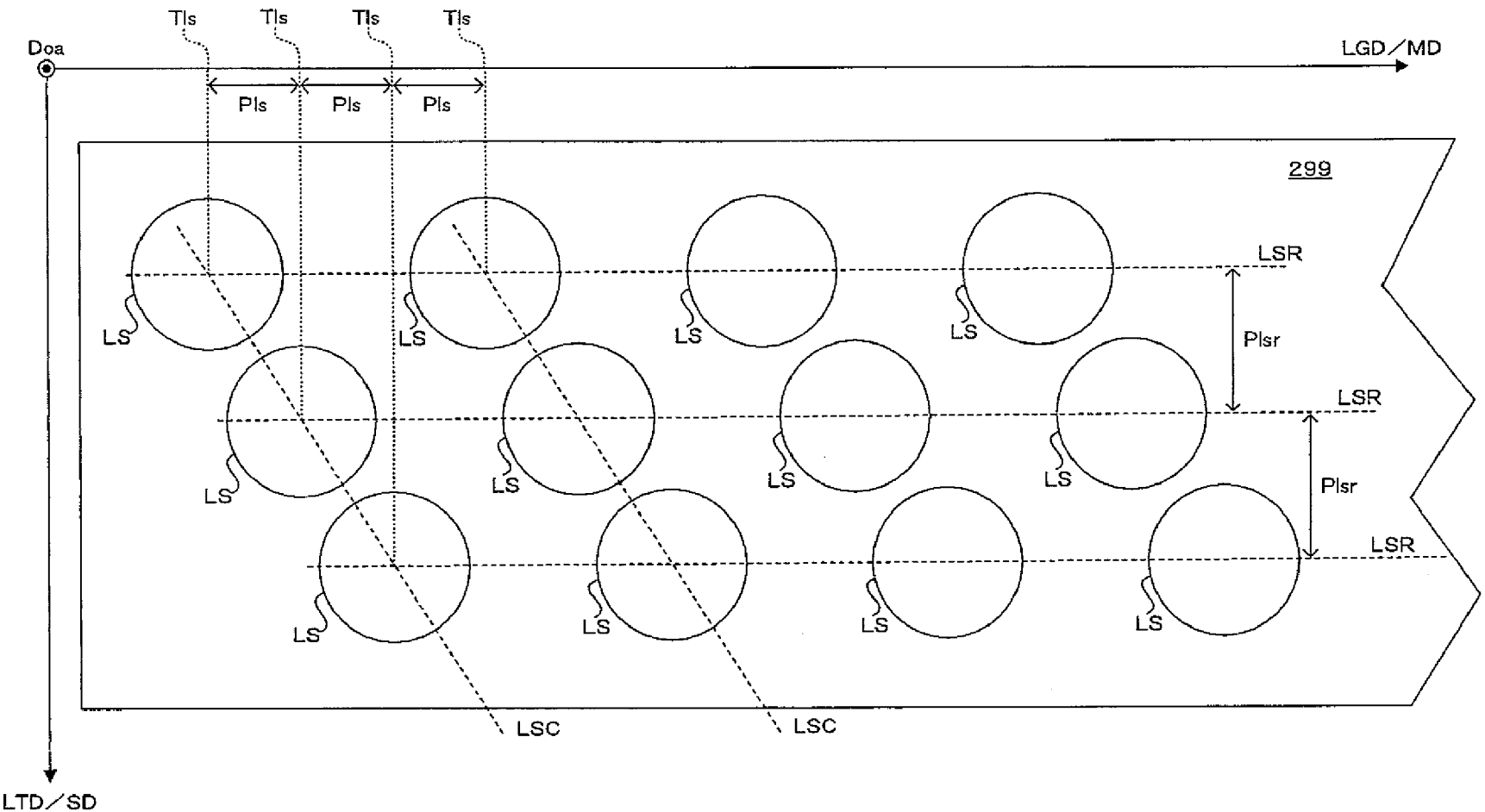
FIG. 7 is a plan view showing a configuration of a lens array.

FIG. 7 is a plan view showing a configuration of the lens array, and corresponds to the case of viewing the lens array from the destination side of the proceeding direction Doa of the light beam. It should be noted that each of the lenses LS in the drawing is provided to a reverse surface 2991-*t* of a lens array substrate 2991, and the drawing shows the configuration of the reverse surface 2991-*t* of the lens array substrate. As shown in FIG. 6, for example, in the lens array 299, the lenses LS are disposed so as to correspond respectively to the light emitting element groups 295. In other words, in each of the lens arrays 299, the lenses LS are arranged two-dimensionally apart from each other. Details thereof are as follows.

There are disposed three lenses LS at positions different in width direction LTD from each other to form the lens column LSC. In each of the lens columns LSC, the three lenses LS are disposed so as to be shifted a lens pitch Pls from the adjacent one of the lenses LS in the longitudinal direction LGD. Further, a plurality of lens columns LSC is disposed in the longitudinal direction LGD with a lens column pitch (=Pls×3). As described above, the lenses LS are disposed in the longitudinal direction LGD with the lens pitch Pls, and the positions Tls in the longitudinal direction LGD of the respective lenses LS are different from each other.

From another perspective, it can also be said that the lenses LS are disposed as follows. That is, a plurality of lenses LS is disposed in the longitudinal direction LGD to form a lens row LSR, and three lens lows LSR are disposed at positions different in width direction LTD from each other. These three lens rows LSR are disposed in the width direction LTD with a lens row pitch Plsr. Moreover, the lens rows LSR are shifted the lens pitch Pls in the longitudinal direction LGD from adjacent one of the lens rows LSR. Therefore, it results that the lenses LS are disposed in the longitudinal direction LGD with the lens pitch Pls, and the positions Tls of the respective lenses LS in the longitudinal direction LGD are different from each other. It should be noted that in the drawing the position of the lens LS is represented by the peak (i.e., a point with the largest sag) of the lens LS, and the position Tls of the lens LS in the longitudinal direction LGD is represented by the foot of the perpendicular drawn from the peak of the lens LS to the axis of the longitudinal direction LGD.

Figure 8:
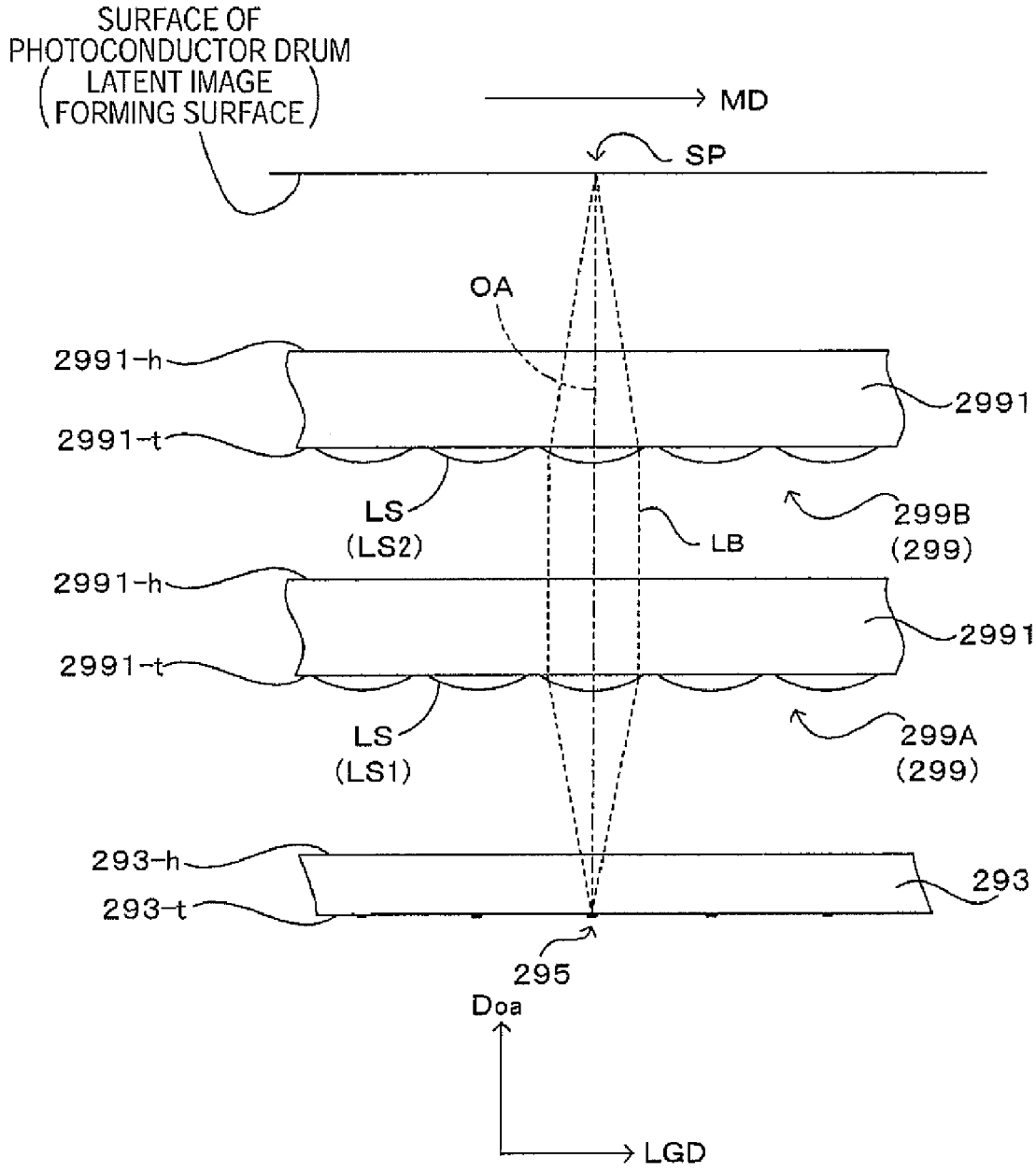
FIG. 8 is a cross-sectional diagram of the lens array, the head substrate, and soon along the longitudinal direction.

FIG. 8 is a cross-sectional diagram of the lens arrays and the head substrate along the longitudinal direction, and shows a cross-sectional surface along the longitudinal direction including the optical axis of the lenses LS provided to the lens arrays. Each of the lens arrays 299 is elongated in the longitudinal direction LGD, and has the lens array substrate 2991 with a light transmissive property. The lens array substrate 2991 is made of glass with a relatively low linear expansion coefficient. The lenses LS are formed on the reverse surface 2991-*t* of the lens array substrate 2991 among a front surface 2991-*h* and the reverse surface 2991-*t* of the lens array substrate 2991. The lenses LS can be formed, for example, of light curing resin.

In the line head 29, in order for achieving enhancement of freedom of optical design, two lens arrays 299 (299A, 299B) having the configuration described above are disposed side by side in the proceeding direction Doa of the light beam. These two lens arrays 299A, 299B are opposed to each other across a pedestal 296 (FIGS. 3 and 4), and the pedestal 296 has a function of defining a distance between the lens arrays 299A, 299B. In the manner as described above, it results that two lenses LS1, LS2 disposed in the proceeding direction Doa of the light beam are provided to each of the light emitting element groups 295 (FIGS. 3, 4, and 8). Here, the lens LS of the lens array 299A on the upstream side in the proceeding direction Doa of the light beam corresponds to a first lens LS1, and the lens LS of the lens array 299B on the downstream side in the proceeding direction Doa of the light beam corresponds to a second lens LS2.

A light beam LB emitted from the light emitting element group 295 is imaged by the two lenses LS1, LS2 disposed so as to be opposed to the light emitting element group 295, and thus a spot DP is formed on the surface (latent image forming surface) of the photoconductor drum. In other words, the two lenses LS1, LS2 form an imaging optical system, and the imaging optical system is disposed so as to be opposed to each of the light emitting element groups 295. The optical axis OA of the imaging optical system is parallel to the proceeding direction Doa of the light beam, and passes through the centroid position of the light emitting element group 295. The imaging optical system has a so-called inverse magnification optical property. In other words, the imaging optical system images an inverted image, and the absolute value of the optical magnification of the imaging optical system is greater than 1.

The specific configurations of the line head 29 and the image forming apparatus equipped with the line head 29 are as described hereinabove. An exposure operation of the line head 29 will now be explained as follows. The line head 29 exposes the surface of the photoconductor drum 21 based on the video data VD. The video data VD is generated in the main controller MC (FIG. 2). Specifically, the main controller MC has an image processing section 51, and the image processing section 51 executes signal processing on the image data included in the image formation command from the external device, thereby forming the video data VD. This signal processing is executed on the image corresponding to one page every input of a vertical request signal VREQ from the head controller HC. Then, the main controller MC outputs the video data VD corresponding to one line to the head controller HC every time a horizontal request signal HREQ is received from the head controller HC.

The head controller HC generates the vertical request signal VREQ and the horizontal request signal HREQ based on the sync signal Vsync provided from the engine controller EC. Further, the head controller HC outputs the video data VD, which is received from the main controller MC, to a light emission control module LEC (FIG. 9) provided to the line head 29. The light emission control module LEC is provided to each of the line heads 29 corresponding respectively to the four colors.

FIG. 9 is a block diagram showing a configuration of the light emission control module. The light emission control module LEC is composed of a control circuit 55 for controlling each sections of the light emission control module LEC, a drive circuit 57 for driving the light emitting elements 2951, the light intensity sensors SC (FIG. 6), and a memory 56. The control circuit 55 controls the drive circuit 57 driving the light emitting elements based on the video data VD received from the head controller HC. On this occasion, the control circuit 55 controls the drive circuit 57 so as to drive the light emitting elements 2951 based on the deterioration rates of the respective light emitting elements 2951, which has previously been obtained and stored in the memory 56, thereby making the light emitting elements 2951 emit light with a substantially normalized light intensity (a second process). It should be noted that a method of identifying the deterioration rate of the light emitting element 2951 will be described later.

Figure 10:
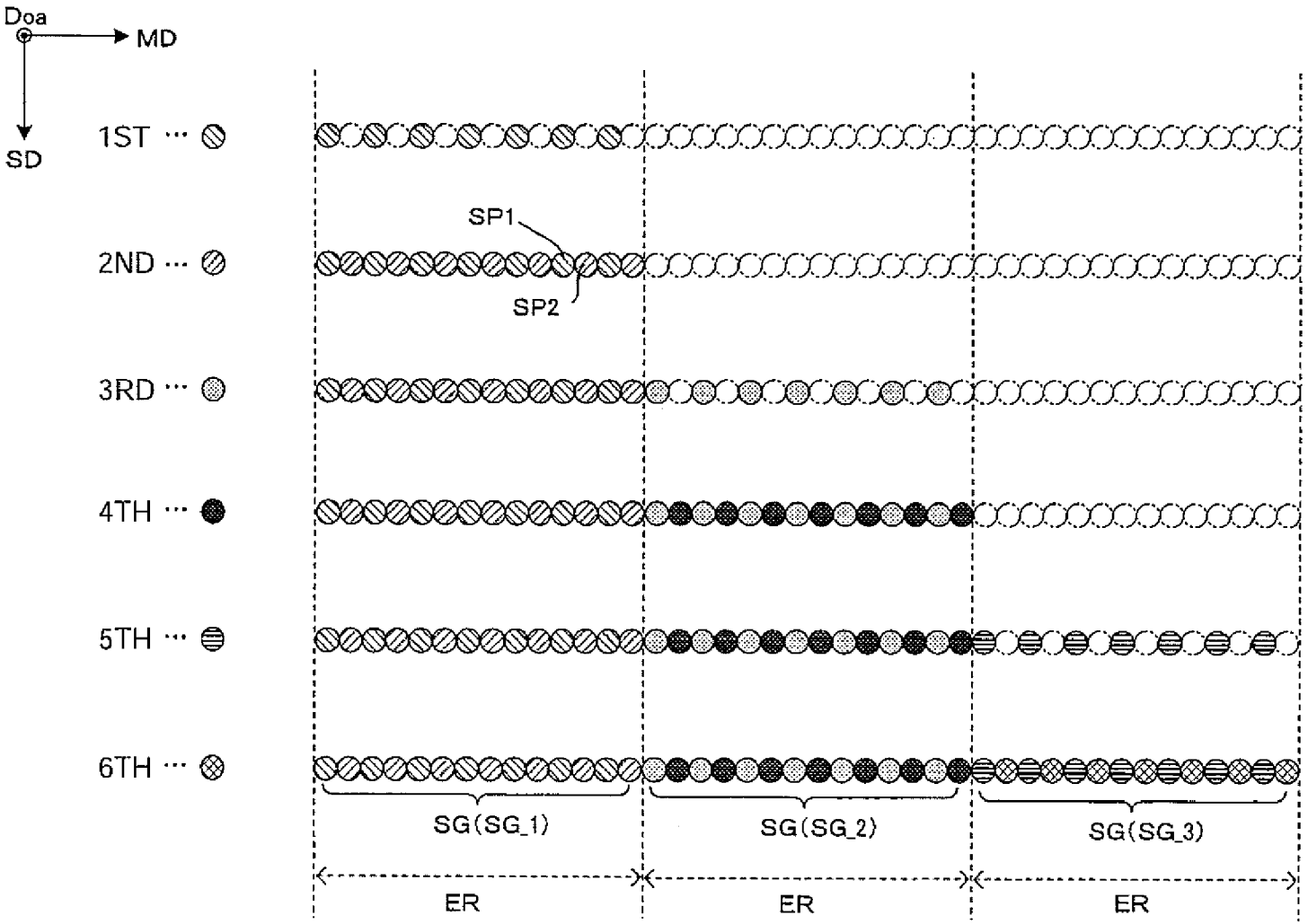
FIG. 10 is a diagram showing a spot latent image forming operation by the line head.

Incidentally, as shown in FIG. 6, the line head 29 has a plurality of light emitting element groups 295 disposed two-dimensionally. Therefore, in order for appropriately forming the latent image on the surface of the photoconductor drum 21, the head controller HC and the light emission control module LEC control the light emitting element groups 295 in cooperation with each other in the following manner. FIG. 10 is a diagram showing a spot latent image forming operation by the line head. Hereinafter, the spot latent image forming operation by the line head 29 will be explained with reference to FIGS. 5, 6, and 10. As an outline, the light emitting element groups 295 respectively form spot groups SG in exposure areas ER different from each other, thereby executing the latent image formation. In the latent image forming operation, the head controller HC and the light emission control module LEC makes each of the light emitting elements 2951 at predetermined timing in cooperation with each other while conveying the surface of the photoconductor drum 21 in the sub-scanning direction SD, thereby forming a plurality of spots aligned in the main-scanning direction MD. It should be noted that the reference elements Erf are kept off in the latent image forming operation. Hereinafter, the details of the operation will be explained.

Firstly, when the light emitting element row 2951R_2 of each of the light emitting element groups 295 (e.g., 295_1, and 295_4) belonging to the light emitting element group row 295R_A on the uppermost stream side in the width direction LTD emits light, seven spots indicated by a hatching pattern of "1ST" shown in FIG. 10 are formed. The light emitting element row 2951R_1 emits light subsequently to the light emission of the light emitting element row 2951R_2 to form seven spots indicated by a hatching pattern of "2ND" shown in FIG. 10. As described above, the two light emitting elements 2951 disposed in the longitudinal direction LGD with the light emitting element pitch Pel can form the two spots (e.g., the spots SP1, SP2) disposed in the main-scanning direction MD adjacently to each other. Here, the reason to sequentially emit light from the light emitting element row 2951R on the downstream side in the width direction LTD is for coping with the inverting characteristic provided to the imaging optical system.

Subsequently, the light emitting element groups 295 (e.g., 295_2) belonging to the light emitting element group row 295R_B on the downstream side of the light emitting element group row 295R_A in the width direction LTD performs the light emitting operation in the same manner as the light emitting element group row 295R_A to form spots indicated by hatching patterns of "3RD" and "4TH" shown in FIG. 10. Further, the light emitting element groups 295 (e.g., 295_3) belonging to the light emitting element group row 295R_C on the downstream side of the light emitting element group row 295R_B in the width direction LTD performs the light emitting operation in the same manner as the light emitting element group row 295R_A to form spots indicated by the hatching patterns of "5TH" and "6TH" shown in FIG. 10. As described above, by performing the light emitting operations corresponding to the first through sixth times, the plurality of spots is formed side by side in the main-scanning direction MD.

In the manner as described above, the light emitting element groups 295_1, 295_2, 295_3, . . . respectively form the spot groups SG_1, SG_2, SG_3, . . . , side by side in the main-scanning direction MD thereby forming a line latent image corresponding to one line in the main-scanning direction MD. Then, by forming the line latent images sequentially in accordance with the movement of the surface of the photoconductor drum 21 in the sub-scanning direction SD, a two-dimensional electrostatic latent image can be formed.

Incidentally, the light emitting elements 2951 are deteriorated while repeating the exposure operation. Therefore, in the present embodiment, the deterioration rate representing the degree of deterioration of the light emitting element 2951 is obtained, and the light intensity of the light emitting element 2951 is controlled based on the deterioration rate. Hereinafter, a light intensity control technology according to the present embodiment will be explained with reference to FIGS. 11 and 12.

Figure 11:
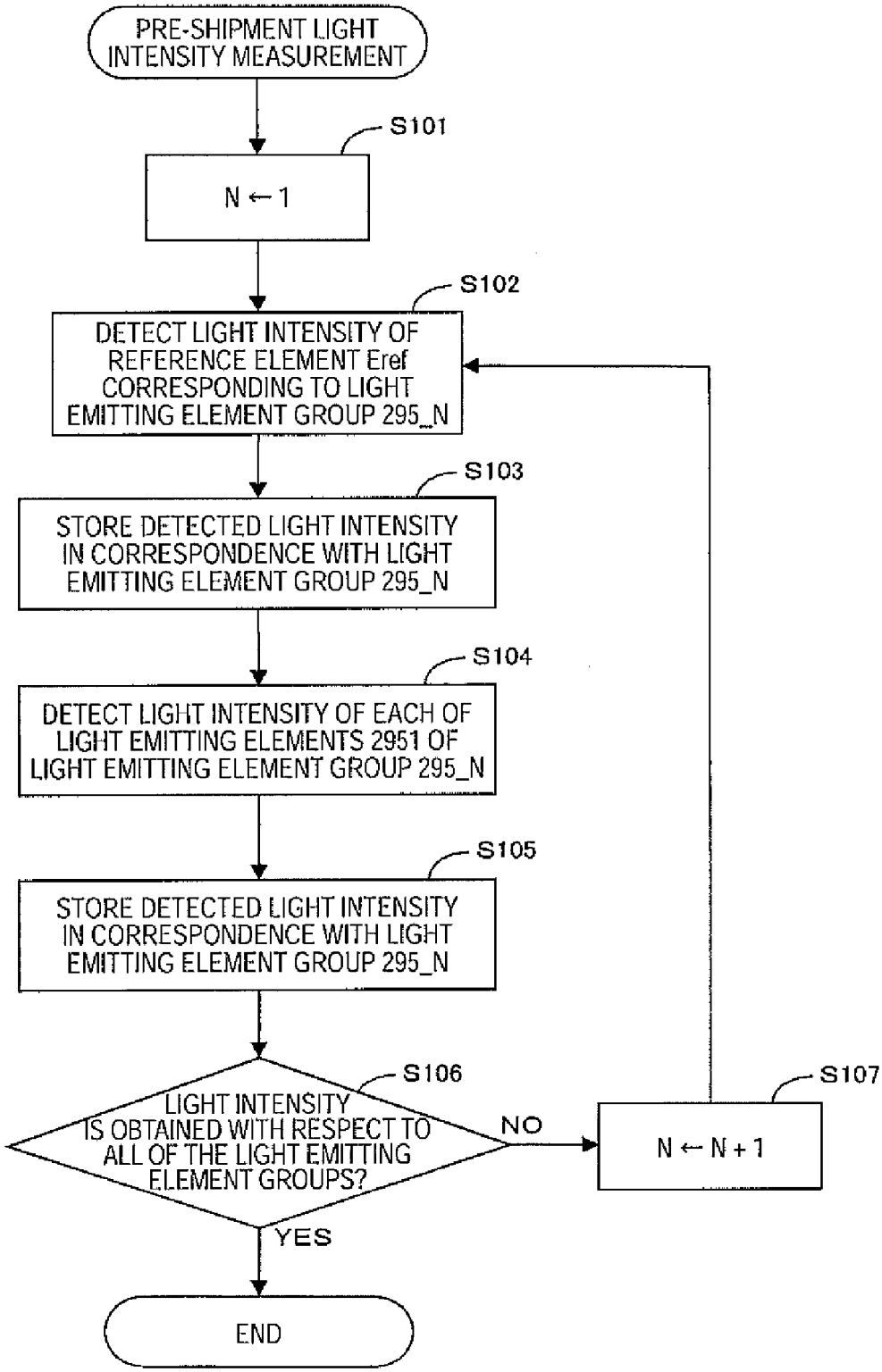
FIG. 11 is a flowchart showing a pre-shipment light intensity measurement executed before shipment of the line head.
Figure 12:
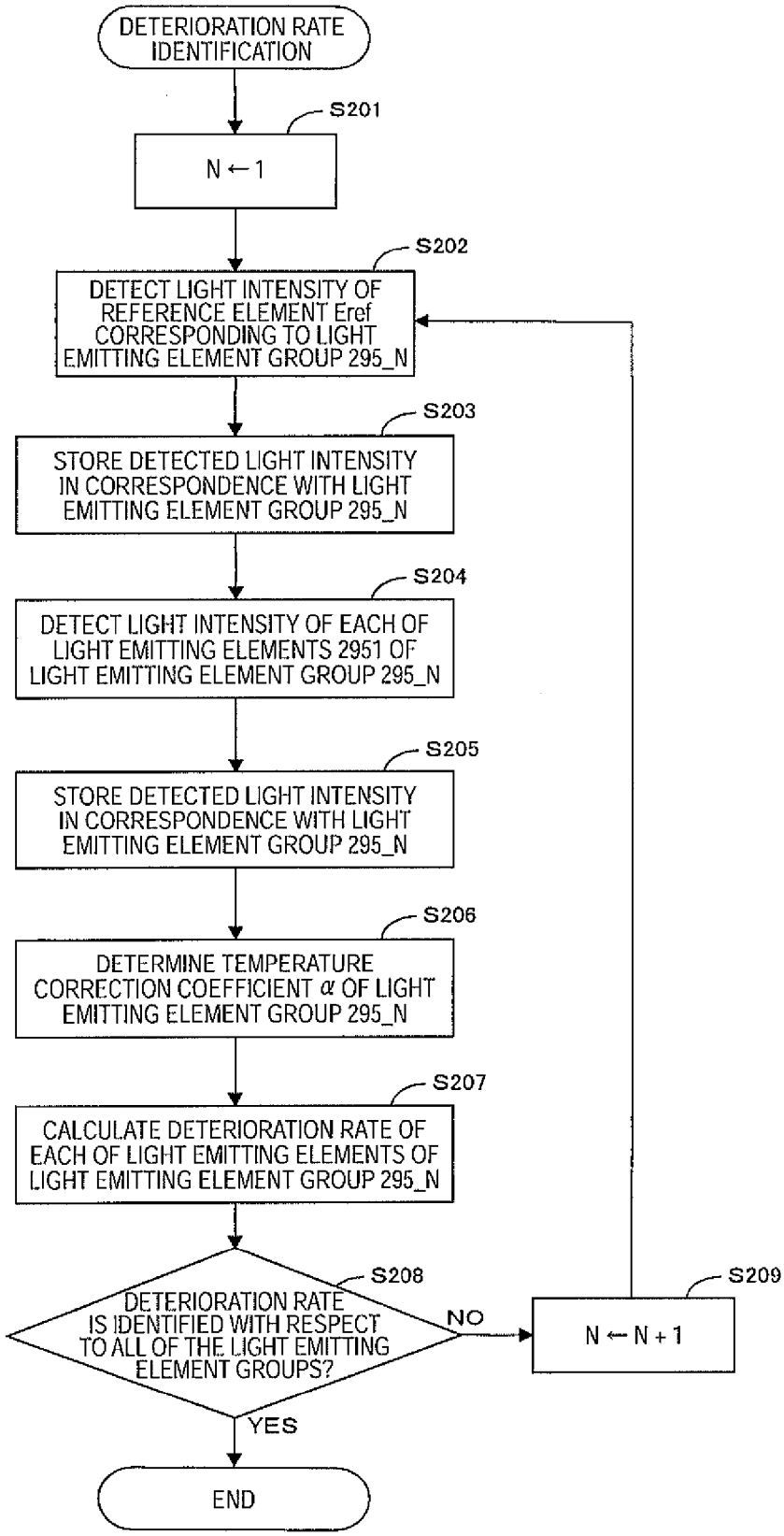
FIG. 12 is a flowchart showing deterioration rate identification executed at predetermined timing after shipment.

FIG. 11 is a flowchart showing a pre-shipment light intensity measurement executed before shipment of the line head. FIG. 12 is a flowchart showing deterioration rate identification executed at predetermined timing after shipment. Hereinafter, the degradation rate identification of the light emitting element will be explained using these flowcharts. It should be noted that the operations corresponding to these flowcharts are executed by the control circuit 55 controlling each of the sections of the light emission control module LEC.

The light intensity of each of the light emitting elements 2951 and the reference elements Erf is measured with respect to all of the light emitting element groups 295_1, 295_2, . . . , 295_N, . . . in the pre-shipment light intensity measurement shown in FIG. 11. A specific operation is as follows. In the step S101, 1 is substituted for a variable N. The variable N is a number attached to the end of the reference numeral 295 of each of the light emitting element groups following the underbar in order for identify the light emitting element group 295. In the step S102, the reference elements Erf_1, Erf_2 corresponding to the light emitting element group 295_N are sequentially made to emit light, and the light intensity of each of the reference elements Erf_1, Erf_2 is detected by the light intensity sensor SC. Subsequently, the detected light intensities are stored in the memory 56 in correspondence with the light emitting element group 295_N (step S103). Further, in the step S104, the light emitting elements 2951 of the light emitting element group 295_N are sequentially made to emit light, and the light intensity of each of the light emitting elements 2951 is detected by the light intensity sensor SC. Subsequently, the detected light intensities are stored in the memory 56 in correspondence with the light emitting element group 295_N (step S105). In the step S106, whether or not the process of obtaining the light intensity by executing the steps S102 through S105 is completed with respect to all of the light emitting element groups 295 is determined. Then, if the light intensity acquisition is not completed with respect to all of the light emitting element groups 295 ("NO" in the step S106), the process proceeds to the step S107 to increment the variable N by 1, and then returns to the step S102. On the other hand, if the light intensity acquisition is completed with respect to all of the light emitting element groups 295 ("YES" in the step S106), the pre-shipment light intensity measurement is terminated.

Further, in the present embodiment, the deterioration rate identification (a first process) of the light emitting elements 2951 is executed (FIG. 12) at the timing (e.g., the timing between the exposure operations) when the exposure operation is not executed after shipment of the line head 29. Also in the deterioration rate identification shown in FIG. 12, the light intensity of each of the light emitting elements 2951 and the reference elements Erf is measured with respect to all of the light emitting element groups 295_1, 295_2, . . . , 295_N, . . . similarly to the pre-shipment light intensity measurement. A specific operation is as follows. In the step S201, 1 is substituted for the variable N. In the step S202, the reference elements Erf_1, Erf_2 corresponding to the light emitting element group 295_N are sequentially made to emit light, and the light intensity of each of the reference elements Erf_1, Erf_2 is detected by the light intensity sensor SC. Subsequently, the detected light intensities are stored in the memory 56 in correspondence with the light emitting element group 295_N (step S203). Further, in the step S204, the light emitting elements 2951 of the light emitting element group 295_N are sequentially made to emit light, and the light intensity of each of the light emitting elements 2951 is detected by the light intensity sensor SC. Subsequently, the detected light intensities are stored in the memory 56 in correspondence with the light emitting element group 295_N (step S205).

It should be noted that in the present embodiment a plurality of light intensity sensors SC is provided. Therefore, it is possible to obtain the detected light intensity of the light emitting element 2951 or the reference element Erf as a sum of the output values of the light intensity sensors SC. It should be noted that it is also possible to use the output value of the light intensity sensor SC the nearest to the light emitting element 2951 or the reference element Erf as the detected light intensity of the light emitting element 2951 or the reference element Erf.

Then, based on the light intensity detected along the steps S202 through S205, the temperature correction coefficient a is determined (step S206). Subsequently, what is obtained by multiplying the ratio between the detected light intensities of the light emitting element 2951 before and after the shipment by the temperature correction coefficient a is obtained as the deterioration rate of the light emitting element 2951 (step S207). The principle of the deterioration rate identification described above is as follows.

The detected light intensity Pa of the light emitting element 2951 in the pre-shipment light intensity measurement is obtained by the following formula.

(detected light intensity *Pa*)=(light intensity base value)×(incident distance coefficient)×(sensor gain) Formula 1

It should be noted that the light intensity base value is the light intensity of the light emitting element 2951 with no deterioration. Further, the incident distance coefficient is a coefficient corresponding to the distance from the light emitting element 2951 to the light intensity sensor SC, and corresponds to an attenuation rate at which the light intensity of the light emitted by the light emitting element 2951 is attenuated until the light reaches the sensor SC. Further, the sensor gain is a gain of the light intensity sensor SC.

On the other hand, the detected light intensity Pb of the light emitting element 2951 in the deterioration rate identification is obtained by the following formula.

(detected light intensity *Pb*)=(light intensity base value)×(deterioration rate)×(incident distance coefficient)×(proportion of light emitting element temperature variation)×(sensor gain) Formula 2

Here, the proportion of the light emitting element temperature variation corresponds to the proportion of the light intensity variation of the light emitting element 2951 as an object of the deterioration rate identification due to the temperature difference between the time point of the pre-shipment light intensity measurement and the time point of the deterioration rate identification. Further, in the related art technology, since the ratio between the detected light intensities Pa, Pb is simply obtained as the deterioration rate, such a proportion of the light emitting element temperature variation affects the deterioration rate, and the deterioration rate cannot accurately be obtained in some cases. In other words, as expressed by the following formula, the detected light intensity ratio is obtained by multiplying the deterioration rate by the proportion of the light emitting element temperature variation, but does not accurately represent the deterioration rate.

(detected light intensity *Pb*)/(detected light intensity *Pa*)=(deterioration rate)×(proportion of light emitting element temperature variation) Formula 3

In contrast, in the present embodiment, the temperature correction coefficient a is obtained based on the detected light intensities of the reference element Erf before and after the shipment. In other words, the reference elements Erf are provided to each of the light emitting element groups 295, and are at substantially the same temperature as that of the corresponding light emitting element group 295. Moreover, since the reference elements are kept off during the exposure operation, no deterioration is caused by the exposure operation. Therefore, the ratio between the detected light intensities Pa-rf, Pb-rf of the reference element Erf before and after the shipment is expressed by the following formula.

(detected light intensity *Pb-rf*)/(detected light intensity *Pa-rf*)=(proportion of light emitting element temperature variation)=α Formula 4

Therefore, in the present embodiment, the deterioration rate of each of the light emitting elements 2951 is obtained based on the following formula obtained by dividing the formula 3 by the temperature correction coefficient α.

(deterioration rate)=(detected light intensity *Pb*)/(detected light intensity *Pa*)/α Formula 5

Thus, it becomes possible to accurately obtain the deterioration rate while suppressing the influence of the temperature.

In the step S208, whether or not the process of identifying the deterioration rate of each of the light emitting elements 2951 by executing the steps S202 through S207 is executed with respect to all of the light emitting element groups 295 is determined. Then, if the identification of the deterioration rate is not completed with respect to all of the light emitting element groups 295 ("NO" in the step S208), the process proceeds to the step S209 to increment the variable N by 1, and then returns to the step S202. On the other hand, if the identification of the deterioration rate is completed with respect to all of the light emitting element groups 295 ("YES" in the step S208), the identification of the deterioration rate is terminated.

It should be noted that, as shown in FIG. 5, two reference elements Erf_1, Erf_2 are provided to each of the light emitting element groups 295. Therefore, the deterioration rate of each of the light emitting elements 2951 of the light emitting element row 2951R_1 is obtained based on the temperature correction coefficient a obtained from the reference element Erf_1. On the other hand, the deterioration rate of each of the light emitting elements 2951 of the light emitting element row 2951R_2 is obtained based on the temperature correction coefficient a obtained from the reference element Erf_2. In other words, it is arranged that, when obtaining the deterioration rate of each of the light emitting elements 2951, by using the temperature correction coefficient a obtained from the reference element Erf closer to the light emitting element 2951, the deterioration rate of each of the light emitting elements 2951 can more accurately be obtained.

As described above, in the present embodiment, the deterioration rate (the degree of deterioration) of the light emitting element 2951 is obtained based on the light intensities of the reference element Erf and the light emitting element 2951. The reference elements Erf are provided to each of the light emitting element groups 295, and are at substantially the same temperature as that of the corresponding light emitting element group 295. Moreover, since the reference elements Erf are kept off during the exposure operation, no deterioration is caused by the exposure operation. In other words, the present embodiment uses the light intensity of the reference elements Erf at substantially the same temperature as that of the light emitting element group 295 and free from the deterioration, thereby making it possible to keep obtaining the deterioration rate of each of the light emitting elements 2951 of the light emitting element group 295 with high accuracy while suppressing the influence of the temperature. Therefore, by controlling the light intensity of each of the light emitting elements 2951 based on the deterioration rate, the line head 29 (the exposure head) can suppress the light intensity variation of the light emitting elements 2951 due to the deterioration, thereby performing preferable exposure. Further, by using such a line head 29, the image forming apparatus can form a preferable image.

Figure 13:
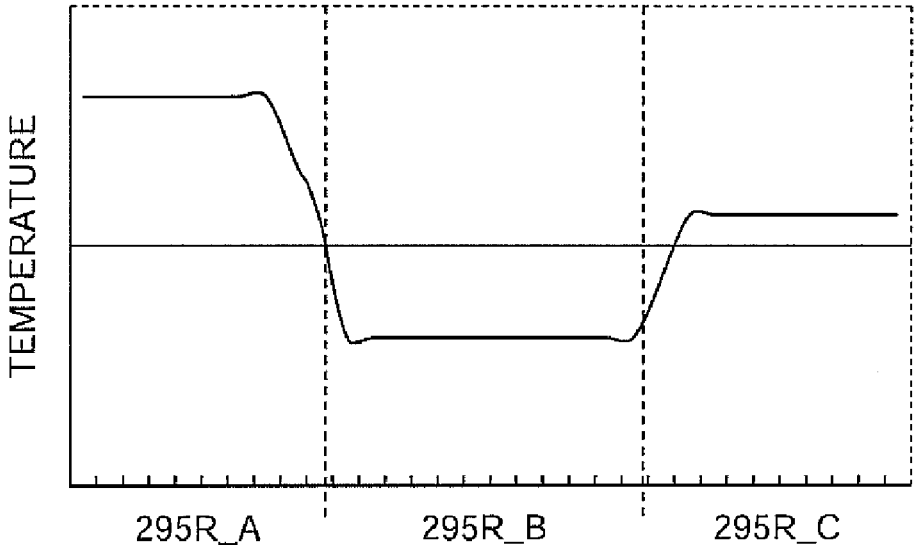
FIG. 13 is a diagram showing internal temperature of the light emitting element groups in a light emitting element group row.
Figure 14:
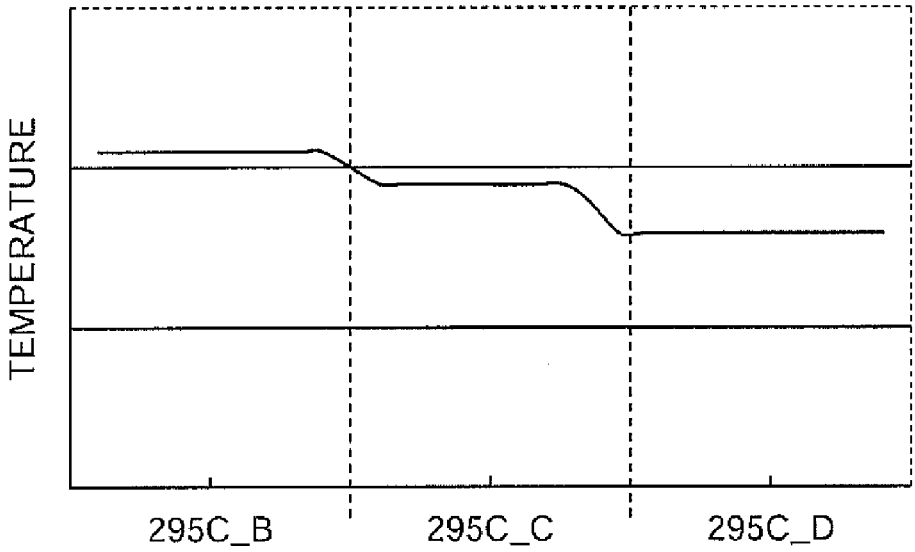
FIG. 14 is a diagram showing internal temperature of the light emitting element groups in a light emitting element group column.

Further, in the present embodiment, since the reference elements Erf are provided to each of the light emitting element groups 295, the following advantage can be obtained. That is, as described above, a plurality of light emitting element groups 295 are arranged discretely. Therefore, the light emitting elements 2951 in the same light emitting element group 295 are at substantially the same temperature on the one hand, the light emitting elements 2951 in the different light emitting element groups 295 may sometimes be different in temperature from each other on the other hand. To cite an instance, as shown in FIG. 13, in some cases, the light emitting element groups 295 are different in temperature between the light emitting element group rows 295R. It should be noted that FIG. 13 is a diagram showing the temperature in the light emitting element group in each of the light emitting element group rows 295R_A, 295R_B, and 295R_C (FIG. 6), wherein the lateral axis represents the light emitting element group rows, and the vertical axis represents the temperature. Alternatively, as shown in FIG. 14, there is also the case in which the light emitting element groups 295 are different in temperature between the light emitting element group columns 295C. It should be noted that FIG. 14 is a diagram showing the temperature in the light emitting element group in each of the light emitting element group columns 295C_A, 295C_B, and 295C_C (FIG. 6), wherein the lateral axis represents the light emitting element group columns, and the vertical axis represents the temperature. Therefore, if the reference elements Erf are arranged without considering such a temperature distribution as described above, the temperature of the reference element Erf and the temperature of the light emitting element 2951, the deterioration rate of which is attempted to be obtained based on the reference element Erf, are different from each other, which might cause failure in obtaining the deterioration rate accurately. In contrast, in the present embodiment, the reference elements Erf are provided to each of the light emitting element groups 295. Further, the deterioration rate of each of the light emitting elements 2951 of the light emitting element group 295 is obtained based on the reference element Erf provided to the corresponding light emitting element group 295. Therefore, it becomes possible to obtain the deterioration rate of each of the light emitting elements 2951 with further accuracy while suppressing the influence of the temperature distribution caused by discretely arranging the light emitting element groups 295.

Further, the present embodiment applies the invention to the line head 29 using organic Electro-Luminescence elements as the light emitting elements 2951 and the reference elements Erf, and therefore, is preferable. This is because, since the organic Electro-Luminescence elements have the light intensity varying due to deterioration and temperature variation, it is preferable to obtain the degree of deterioration of the light emitting elements 2951 by the invention with high accuracy to realize a preferable exposure operation.

As described above, in the present embodiment, the line head 29 corresponds to an "exposure head" of the invention, the light emitting element group 295 corresponds to "a plurality of light emitting elements" of the invention, the light emission control module LEC corresponds to a "control section" of the invention, the deterioration rate corresponds to a "degree of deterioration" of the invention, and the photoconductor drum 21 corresponds to a "latent image carrier" of the invention. Further, the memory 56 corresponds to a "memory section" of the invention.

It should be noted that the invention is not limited to the embodiment described above, but various modifications can be applied on what is described above within the scope or the spirit of the invention. For example, it is assumed that the light intensity sensors SC have a relatively small temperature variation of the sensor output in the embodiment described above. However, according to the embodiment, even in the case in which the light intensity sensors SC with a large temperature variation of the sensor output are used, it becomes possible to obtain the deterioration rate with high accuracy. Specifically, the deterioration rate can be obtained in the following manner.

In the case in which the temperature variation of the sensor output is large, the detected light intensity Pb of the light emitting element 2951 in the deterioration rate identification is obtained by the following formula.

(detected light intensity *Pb*)=(light intensity base value)×(deterioration rate)×(incident distance coefficient)×(proportion of light emitting element temperature variation)×(sensor gain)×(proportion of sensor temperature variation) Formula 6

Here, the proportion of the sensor temperature variation is a proportion of the variation in the output value of the light intensity sensor SC caused by the temperature difference between the time point of the pre-shipment light intensity measurement and the time point of the deterioration rate identification. In this case, the ratio between the detected light intensities Pa, Pb, namely the detected light intensity ratio is obtained by multiplying the deterioration rate by the proportion of the light emitting element temperature variation and the proportion of the sensor temperature variation as expressed by the following formula.

(detected light intensity *Pb*)/(detected light intensity *Pa*)=(deterioration rate)×(proportion of light emitting element temperature variation)×(proportion of sensor temperature variation) Formula 7

Therefore, the temperature correction coefficient a is obtained based on the detected light intensities of the reference element Erf before and after the shipment. In other words, the reference elements Erf are provided to each of the light emitting element groups 295, and are at substantially the same temperature as that of the corresponding light emitting element group 295. Moreover, since the reference elements are kept off during the exposure operation, no deterioration is caused by the exposure operation. Therefore, the ratio between the detected light intensities Pa-rf, Pb-rf of the reference element Erf before and after the shipment is expressed by the following formula.

(detected light intensity *Pb-rf*)/(detected light intensity *Pa-rf*)=(proportion of light emitting element temperature variation)×(proportion of sensor temperature variation)=α Formula 8

Therefore, it becomes possible to obtain the deterioration rate with accuracy while suppressing the influence of the temperature by obtaining the deterioration rate of each of the light emitting elements 2951 based on the following formula obtained by dividing the formula 7 by the temperature correction coefficient α.

(deterioration rate)=(detected light intensity *Pb*)/(detected light intensity *Pa*)/α Formula 9

Figure 15:
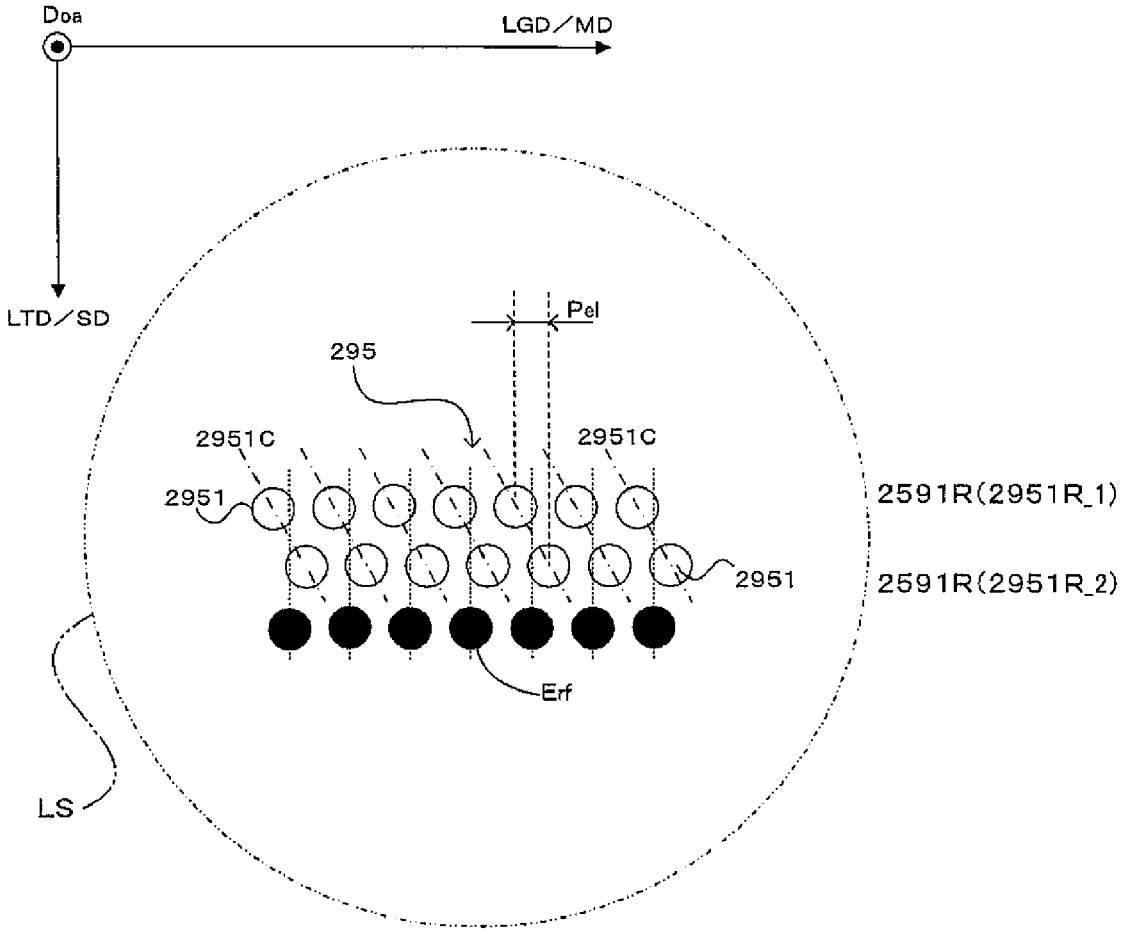
FIG. 15 is a plan view showing another example of a disposition form of reference elements.

Further, in the embodiment described above, the reference element Erf is provided to each of the light emitting element rows 2951R_1, 2951R_2. However, the form of disposing the reference elements Erf is not limited thereto, but the reference elements Erf can be disposed as follows. FIG. 15 is a plan view showing another example of the disposition form of the reference elements. The configuration of the light emitting element groups 295 is substantially the same as in the embodiment described above. It should be noted that in the drawing the two light emitting elements 2951, which are disposed at positions different in the longitudinal direction LGD with the light emitting element pitch Pel and disposed at positions different in the width direction LTD, are illustrated as the light emitting element column 2951C (the dashed line shown in the drawing). In other words, the two light emitting elements 2951 forming the light emitting element column 2951C are disposed in a direction different from either of the longitudinal direction LGD and the width direction LTD. Further, in the drawing, the reference element Erf is provided to each of the light emitting element columns 2951C. In the case of disposing the reference elements Erf as described above, when obtaining the deterioration rate of each of the light emitting elements 2951, it is preferable to use the light intensity of the reference element Erf provided to the light emitting element column 2951C to which the light emitting element 2951 belongs. Thus, the degree of deterioration of the light emitting element 2951 can be obtained with high accuracy.

Figure 16:
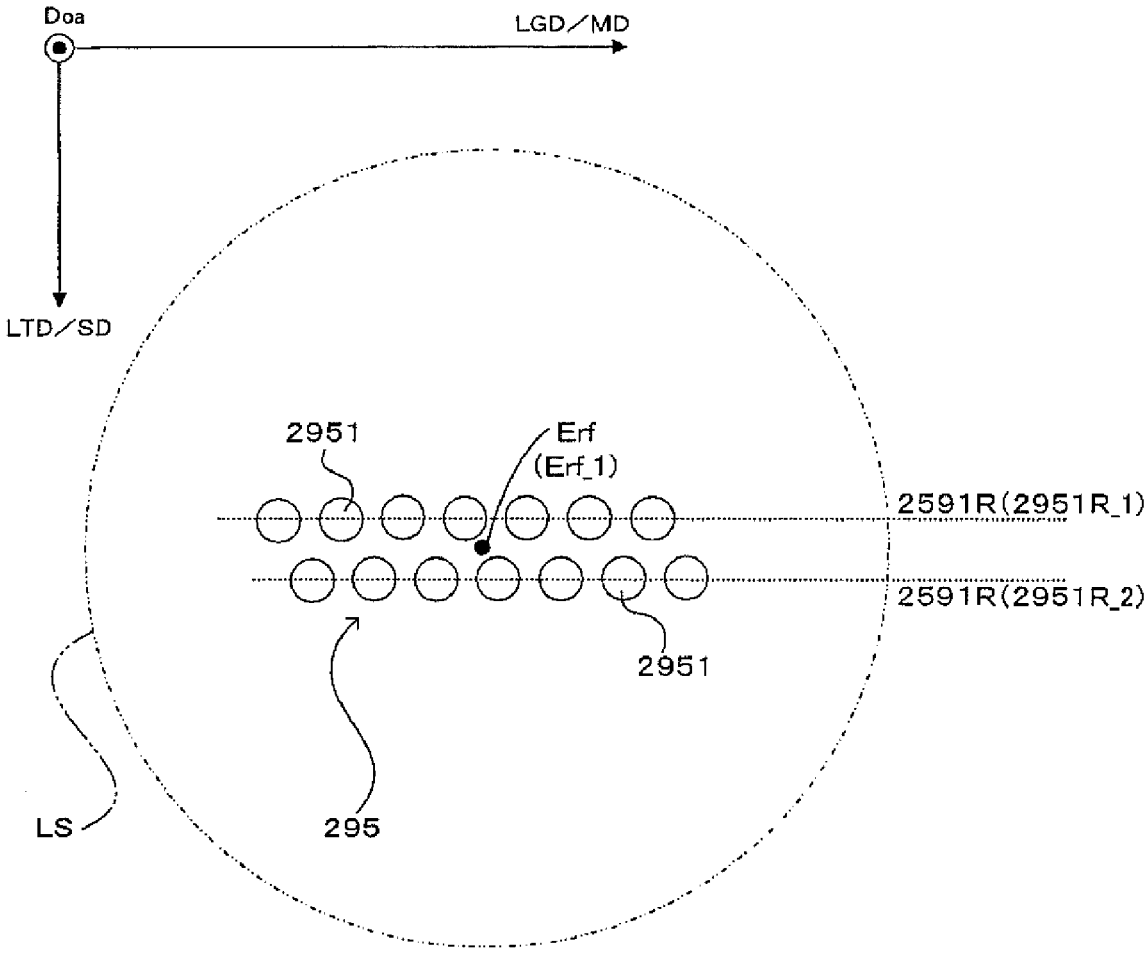
FIG. 16 is a plan view showing still another example of the disposition form of the reference elements.

Further, the reference elements Erf can also be disposed in the following manner. FIG. 16 is a plan view showing still another example of the disposition form of the reference elements. As shown in the drawing, the reference element Erf is surrounded by the light emitting elements 2951 of the corresponding light emitting element group 295. Such a configuration is advantageous to making the reference element Erf at substantially the same temperature as that of the light emitting element group 295, and makes it possible to obtain the deterioration rate of the light emitting element 2951 with higher accuracy. As a result, the line head 29 can perform a preferable exposure operation.

Moreover, in FIG. 16, the light emitting element group 295 is configured symmetrically about a point, and the reference element Erf is disposed at the point of symmetry of the light emitting element group 295. Such a configuration is particularly advantageous to making the reference element Erf at substantially the same temperature as that of the light emitting element group, and makes it possible to obtain the deterioration rate of the light emitting element 2951 with higher accuracy. As a result, the line head 29 can perform a preferable exposure operation.

Figure 17:
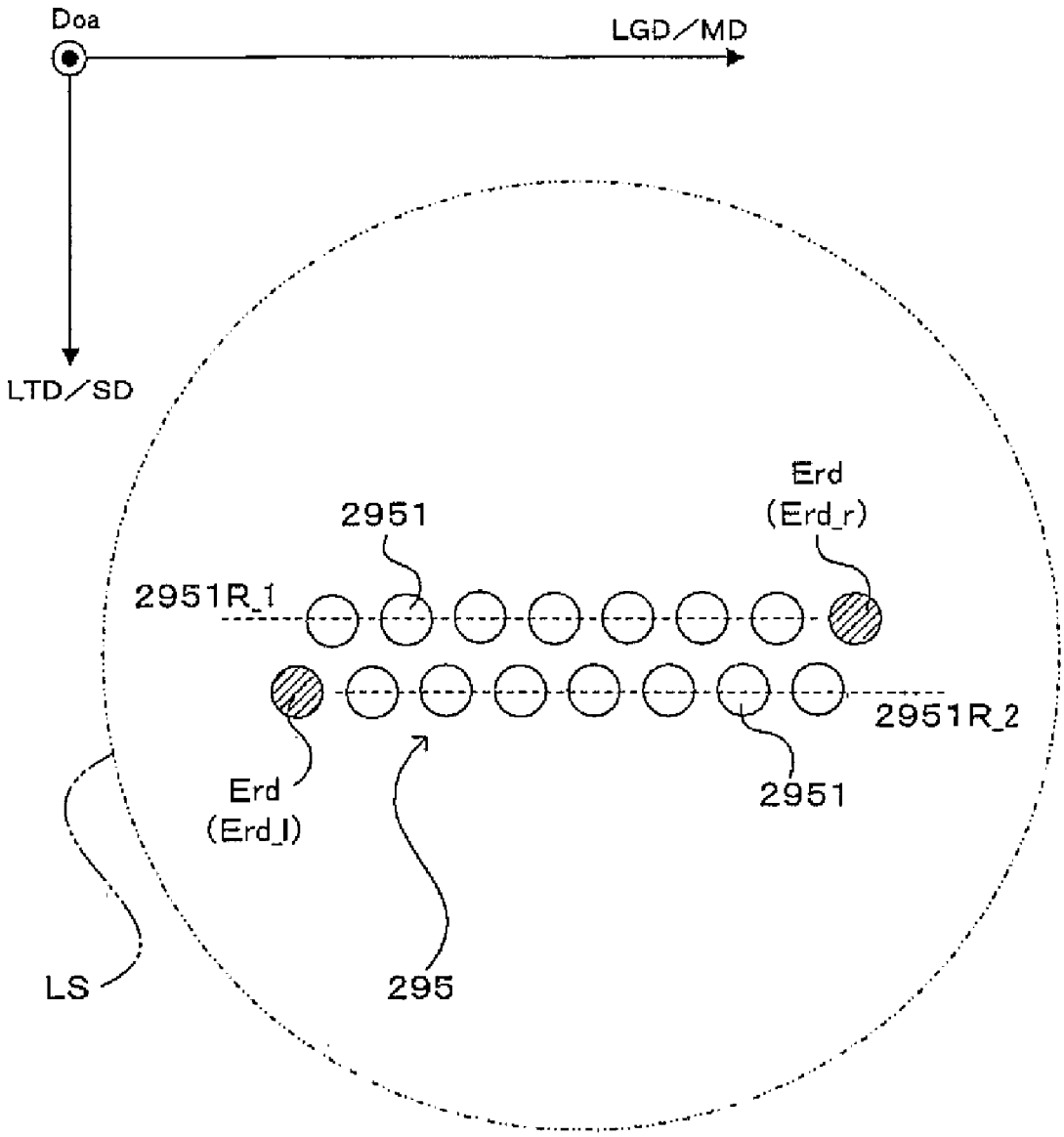
FIG. 17 is a diagram showing another configuration example of the line head.

Further, the line head 29 can also be configured as follows. FIG. 17 is a diagram showing another configuration example of the line head, and corresponds to a planar view of the light emitting element group 295. The embodiment described above and the configuration example shown in FIG. 17 have the point in common that the light emitting element group 295 is composed of 14 light emitting elements 2951. However, in the example shown in FIG. 17, two redundant elements Erd are provided to one light emitting element group 295. Specifically, the redundant element Erd_r is disposed on one side (the right side in the drawing) of the light emitting element row 2951R_1 in the longitudinal direction LGD, and the redundant element Erd_l is disposed on the other side (the left side in the drawing) of the light emitting element row 2951R_2 in the longitudinal direction LGD. The reason for providing such redundant elements Erd is as follows.

Figure 18:
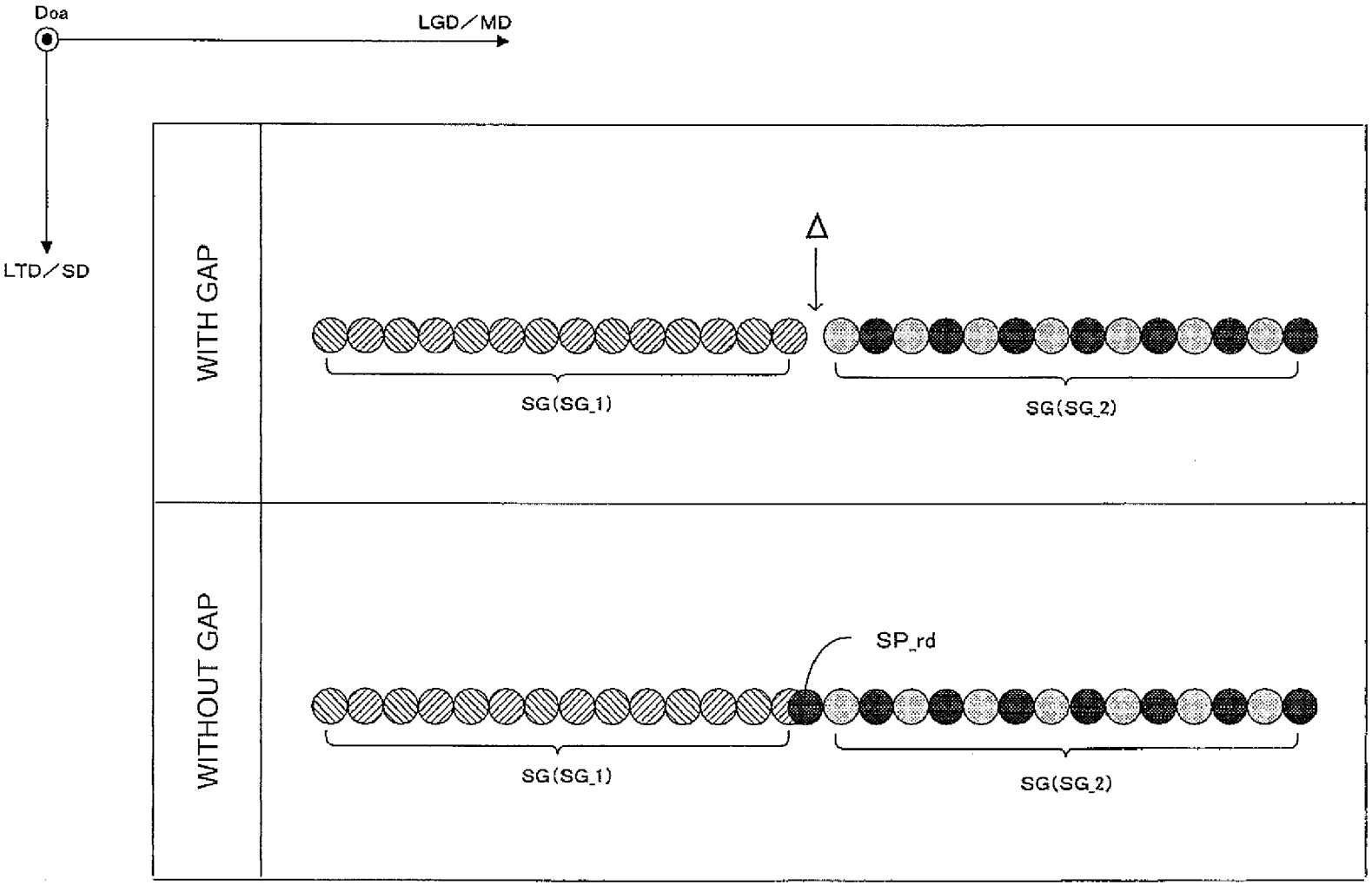
FIG. 18 is a diagram for explaining a reason for providing a redundant element.

FIG. 18 is an explanatory diagram of the reason for providing the redundant elements, and shows the spot groups SG_1, SG_2 formed by the light emitting element groups 295_1, 295_2. In the line head 29 described hereinabove, the spot groups SG formed by the light emitting element groups 295 may sometimes be separated in the main-scanning direction MD due to the variation in the positions of the lenses LS in the lens array 299 or an installation error of the line head 29. As a result, as exemplifying in the field of "WITH GAP" shown in FIG. 18, there is caused the case in which a gap A occurs between the spot group SG_1 and the spot group SG_2. In such a case, a line-like area in which no latent image can be formed is formed along the sub-scanning direction SD, which prevents a preferable latent image forming operation. Therefore, in order for filling such a gap A, the redundant element Erd_r is used in the exposure operation to form the spot SP_rd (the field of "WITHOUT GAP" in the drawing). In other words, although the redundant element Erd is basically not used in the exposure operation, in the case in which the gap problem occurs, the redundant element Erd is used in the exposure operation for filling the gap Δ, thereby making the preferable latent image forming operation possible.

Incidentally, on this occasion, the redundant element Erd_l is not used in the exposure operation. Therefore, it is possible to use the redundant element Erd_l as the reference element Erf. This is because, it becomes possible to keep obtaining the deterioration rate of each of the light emitting elements 2951 of the light emitting element group 295 with high accuracy while suppressing the influence of the temperature.

Further, although in the embodiment described above, three light emitting element group rows 295R are disposed, the number of light emitting element group rows 295R is not limited thereto.

Further, although in the embodiment described above each of the light emitting element groups 295 is composed of two light emitting element rows 2951R, the number of light emitting element rows 2951R forming the light emitting element group 295 is not limited thereto.

Further, although in the embodiment described above the light emitting element row 2951R is composed of 7 light emitting elements 2951, the number of light emitting elements 2951 forming the light emitting element row 2951R is not limited thereto.

Further, although in the embodiment described above the number of light emitting elements 2951 in each of the light emitting element row 2951R is constant, it is also possible to vary the number of light emitting elements 2951 between the light emitting element rows 2951R.

Further, although in the embodiment described above bottom emission organic Electro-Luminescence elements are used as the light emitting elements 2951 and the reference elements Erf, top emission organic Electro-Luminescence elements or light emitting diodes (LED) can also be used.

The entire disclosure of Japanese Patent Applications No. 2008-222240, filed on Aug. 29, 2008 is expressly incorporated by reference herein.

What is claimed is:

1. An exposure head comprising:

at least one light emitting element;

an imaging optical system adapted to image light from the light emitting element;

at least one reference element disposed to the light emitting element; and a control section adapted to control light emission of the light emitting element, and to put off the reference element in a latent image forming operation, wherein the control section obtains a degree of deterioration of the at least one light emitting element based on an intensity of light emitted by the light emitting element at timing other than timing when the latent image formation operation is executed and an intensity of light emitted by the reference element at timing other than timing when the latent image formation operation is executed, and controls light intensity of the light emitting element in the latent image forming operation based on the degree of deterioration.

2. The exposure head according to claim 1, wherein the at least one light emitting element comprises two or more light emitting elements, and the reference element is surrounded by the two or more light emitting elements.

3. The exposure head according to claim 2, wherein the two or more light emitting elements are disposed symmetrically about a point, and the reference element is disposed at the point of symmetry of the two or more light emitting elements corresponding to the reference element.

4. The exposure head according to claim 1, wherein the reference element is disposed outside the two or more light emitting elements.

5. The exposure head according to claim 1, wherein the light emitting element and the reference element are organic Electro-Luminescence elements.

6. An image forming apparatus comprising:

a latent image carrier;

an exposure head having a light emitting element, an imaging optical system adapted to expose the latent image carrier by imaging light from the light emitting element, and a reference element disposed to the light emitting element; and a control section adapted to control light emission of the light emitting element in a latent image forming operation for providing a latent image to the latent image carrier, and to keep the reference element off in the latent image forming operation, wherein the control section obtains a degree of deterioration of the light emitting element based on an intensity of light emitted by the light emitting element at timing other than timing when the latent image formation operation is executed and an intensity of light emitted by the reference element at timing other than timing when the latent image formation operation is executed, and controls light intensity of the light emitting element in the latent image forming operation based on the degree of deterioration.

7. A control method of an exposure head comprising:

(a) obtaining, by making light emitting element and a reference element provided to the exposure head emit light, a degree of deterioration of the light emitting element based on light intensities of the light emitting element and the reference element; and (b) executing a latent image forming operation of imaging light from the light emitting element by an imaging optical system provided to the exposure head to form a latent image on a latent image carrier while controlling a light intensity of the light emitting element based on the degree of deterioration, and stopping the reference element from emitting light in the latent image forming operation.

8. The control method of an exposure head according to claim 7, wherein in step (a), the degree of deterioration of the light emitting element is obtained based on an intensity of light emitted by the light emitting element, an intensity of the light emitted by the reference element, an intensity of light emitted by the light emitting element and stored in a memory section, and an intensity of light emitted by the reference element and stored in the memory section.

* * * * *